US009268249B2

(12) United States Patent
Ueno et al.

(10) Patent No.: US 9,268,249 B2
(45) Date of Patent: Feb. 23, 2016

(54) CHARGING DEVICE

(71) Applicant: CANON KABUSHIKI KAISHA, Tokyo (JP)

(72) Inventors: Takashi Ueno, Tokyo (JP); Yoshiro Nishino, Kashiwa (JP); Tadashi Fukuda, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/524,618

(22) Filed: Oct. 27, 2014

(65) Prior Publication Data

US 2015/0043941 A1 Feb. 12, 2015

Related U.S. Application Data

(63) Continuation of application No. PCT/JP2013/062866, filed on Apr. 26, 2013.

(30) Foreign Application Priority Data

Apr. 27, 2012 (JP) ..... 2012-102469
Apr. 22, 2013 (JP) ..... 2013-089845

(51) Int. Cl.
*G03G 15/02* (2006.01)

(52) U.S. Cl.
CPC ..... *G03G 15/0291* (2013.01)

(58) Field of Classification Search
CPC ..... G03G 15/0291
See application file for complete search history.

(56) References Cited

U.S. PATENT DOCUMENTS 8,626,020 B2 1/2014 Ikeda
8,630,567 B2 1/2014 Makino (Continued)

FOREIGN PATENT DOCUMENTS

JP 2006-91484 A 4/2006
JP 2011-186226 A 9/2011
JP 2012-63592 A 3/2012

OTHER PUBLICATIONS

International Search Report dated Jun. 18, 2013, in Application No. PCT/JP2013/062866.

*Primary Examiner* — Sandra Brase
(74) *Attorney, Agent, or Firm* — Fitzpatrick, Cella, Harper & Scinto

(57) ABSTRACT

A charging device includes: a casing provided with an opening opposing a member-to-be-charged; a discharging wire provided in the casing; a grid electrode provided in the opening; a shutter for opening and closing the opening; a cleaning member for cleaning the grid electrode; and a moving mechanism for reciprocating the shutter and the cleaning member along a longitudinal direction of the opening. The moving mechanism includes a driving member for being rotationally driven, a first moving member, held by the driving member, for moving the shutter with rotational drive of the driving member, and a second moving member, held by the driving member, for moving the cleaning member with the rotational drive of the driving member. The charging device further includes: a mechanism for forming an interval between the shutter and the cleaning member so that the cleaning member moves in advance of the shutter by a predetermined distance when the shutter moves in a closing direction; and a stopper for stopping movement of the cleaning member, and the second moving member includes a holding portion for permitting idling when the shutter moves in the closing direction toward the cleaning member, stopped by the stopper, with rotation of the driving member.

9 Claims, 20 Drawing Sheets

(56) References Cited

U.S. PATENT DOCUMENTS

2010/0158550 A1* 6/2010 Makino et al. ..... 399/45
2011/0222897 A1* 9/2011 Makino ..... 399/92
2011/0318034 A1* 12/2011 Kimura et al. ..... 399/50
2014/0133887 A1 5/2014 Nishino

* cited by examiner (a)

(b)

(a)

(b)

(a)

(b)

CHARGING DEVICE

TECHNICAL FIELD

The present invention relates to a charging device.

BACKGROUND ART

An image forming apparatus of an electrophotographic type in which a photosensitive member is electrically charged by a corona charger. Especially, a product using the corona charger which is called scorotron including a grid electrode for stabilizing a charge potential of the photosensitive member has been known.

With use of the corona charger, when a foreign matter (a toner, an external additive, an electric discharge product or the like) is deposited on the grid electrode, charging non-uniformity occurs on the photosensitive member.

On the other hand, when the corona discharge occurs, an electric discharge product (ozone, nitrogen oxide or the like) is generated. When this is deposited on the photosensitive member and the electric discharge product takes up moisture in a high-humidity environment, the electric discharge product causes image defect which is called image flow. Therefore, a constitution in which with respect to a cleaning member for cleaning a surface of the grid electrode and an opening of the corona charger, the grid electrode is cleaned and the same time the opening is shielded by moving a sheet-like shutter in a longitudinal develop of the opening is described in Japanese Laid-Open Patent Application 2012-063592.

Here, in a constitution in which both the shutter and a cleaning member for cleaning the grid electrode are provided, when the foreign matter to be dropped from the grid electrode by cleaning deposits on the shutter, there is a liability that an agglomeration of the deposited foreign matter drops on the photosensitive member by vibration or the like during movement of the shutter, and therefore the deposition of the foreign matter is not preferred. For that reason, it would be considered that the drop of the agglomeration of the foreign matter on the shutter is suppressed by providing a gap between the cleaning member for cleaning the grid electrode and a leading end of the shutter with respect to the longitudinal direction of the opening so that the foreign matter does not deposit on the shutter.

However, in the constitution in which the gap is provided between the cleaning member and the shutter leading end with respect to the longitudinal direction of the opening, when an entire area of the opening of the corona charger is intended to be shielded, upsizing of the corona charger is caused.

SUMMARY OF THE INVENTION

An object of the present invention is to suppress upsizing of a charging device while suppressing deposition of a foreign matter on a shutter in a constitution in which a cleaning member for cleaning a grid electrode and the shutter for shielding between an opening, provided in a casing of the charging device, and a photosensitive member are moved.

In an aspect of the present invention, there is provided a charging device comprising: a casing provided with an opening opposing a member-to-be-charged; a discharging wire provided in the casing; a grid electrode provided in the opening; a shutter for opening and closing the opening; a cleaning member for cleaning the grid electrode; and a moving mechanism for reciprocating the shutter and the cleaning member along a longitudinal direction of the opening, wherein the moving mechanism includes a driving member for being rotationally driven, a first moving member, held by the driving member, for moving the shutter with rotational drive of the driving member, and a second moving member, held by the driving member, for moving the cleaning member with the rotational drive of the driving member, wherein the charging device further comprises: a mechanism for forming an interval between the shutter and the cleaning member so that the cleaning member moves in advance of the shutter by a predetermined distance when the shutter moves in a closing direction; and a stopper for stopping movement of the cleaning member, and wherein the second moving member includes a holding portion for permitting idling when the shutter moves in the closing direction toward the cleaning member, stopped by the stopper, with rotation of the driving member.

Another object of the present invention will become clear by reading the following detailed description while making reference to the accompanying drawings.

EMBODIMENTS FOR CARRYING OUT THE INVENTION

In the following, a schematic structure of an image forming apparatus will be described, and thereafter, a charging device will be specifically described using the drawings. Incidentally, with respect to dimensions, materials and shapes of constituent elements and relative positions thereof, the scope of the present invention is not intended to be limited only thereto unless otherwise particularly specified.

[Embodiment 1]

First, the schematic structure of the image forming apparatus will be briefly described, and thereafter, the charging device (corona charger) will be specifically described.

1. About Outline of Image Forming Apparatus

In the following, a portion (image forming portion) relating to image formation of a printer 100 will be briefly described.

(About Schematic Structure of Entire Apparatus)

Figure 1:
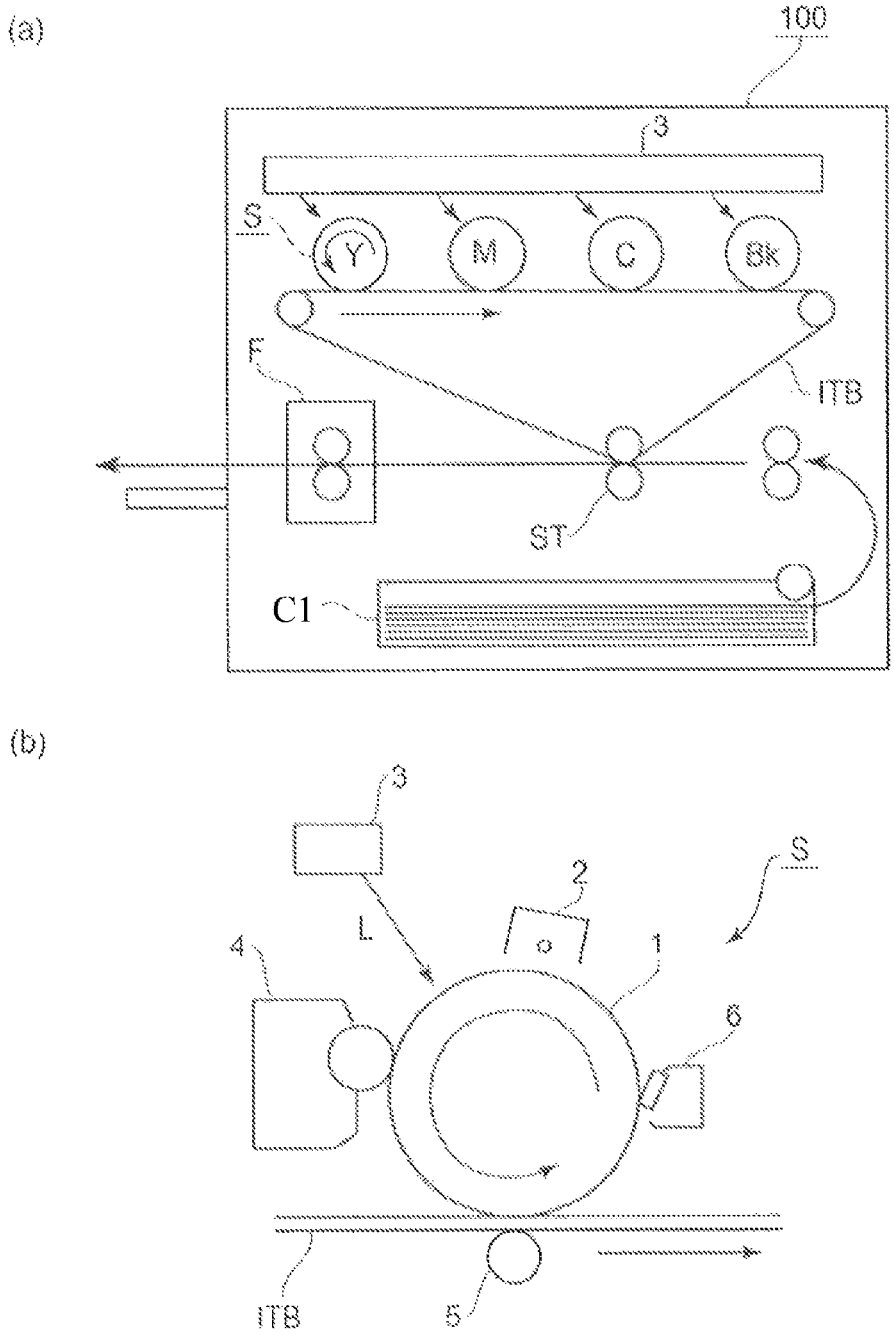
FIG. 1 includes schematic sectional views of an image forming apparatus according to an embodiment.

In FIG. 1, (a) is a schematic view for illustrating a schematic structure of the printer 100 as the image forming apparatus. The printer 100 as the image forming apparatus includes first to fourth stations S (Bk to Y) in which images are formed on respective photosensitive drums with different toners. In FIG. 1, (b) is an enlarged detailed view of the station as an image forming portion. The respective stations are the substantially same except for species (spectral characteristics) of the toners for developing electrostatic images formed on the photosensitive drums, and therefore the first station (Y) will be described as a representative.

The station S (Y) positioned as the image forming portion in an upstreammost side includes a photosensitive drum 1 which is a photosensitive member as a member-to-be-charged and a corona charger 2 as the charging device for electrically charging the photosensitive drum 1. The photosensitive drum 1 is charged by the corona charger 2, and thereafter, the electrostatic image is formed on the photosensitive drum by exposure to light L from a laser scanner 3 constituting a toner image forming device. The electrostatic image formed on the photosensitive drum 1 (first bearing member) is developed into a toner image with a yellow toner accommodated in a developing device 4 constituting the toner image forming device. The toner image formed (by development of the electrostatic image) on the photosensitive drum is transferred onto an intermediary transfer belt ITB as an intermediary transfer member by a transfer roller 5 as a transfer member. A transfer residual toner deposited on the photosensitive drum 1 without being transferred onto the intermediary transfer belt is removed for cleaning by a cleaning device 6 including a blade. Incidentally, the corona charger, the developing device and the like which relate to formation of the toner image on the photosensitive drum 1 (photosensitive drum) is called an image forming portion. Incidentally, the corona charger 2 (charging device) will be specifically described later.

In this way, the toner images transferred from the photosensitive drums 1 provided in the respective stations in the order of yellow (Y), magenta (M), cyan (C) and black (Bk) are superposed on the intermediary transfer belt. Then, the superposed toner images are transferred at a secondary transfer portion ST onto a recording material fed from a cassette C1. A toner remaining on the intermediary transfer belt without being transferred onto the recording material at the secondary transfer portion ST is removed by an unshown belt cleaner. The toner images transferred on the recording material contact and heat-melt the toner, and are fixed on the recording material by a fixing device F for heat-fixing the toner images on the recording material and then the recording material on which the first is fixed is discharged to an outside of the machine (image forming apparatus). The above is the schematic structure of the entire apparatus.

2. About Schematic Structure of Corona Charger

A schematic structure of the charging device according to this embodiment corona charger will be described.

(About Basic Structure of Corona Charger)

Figure 2:
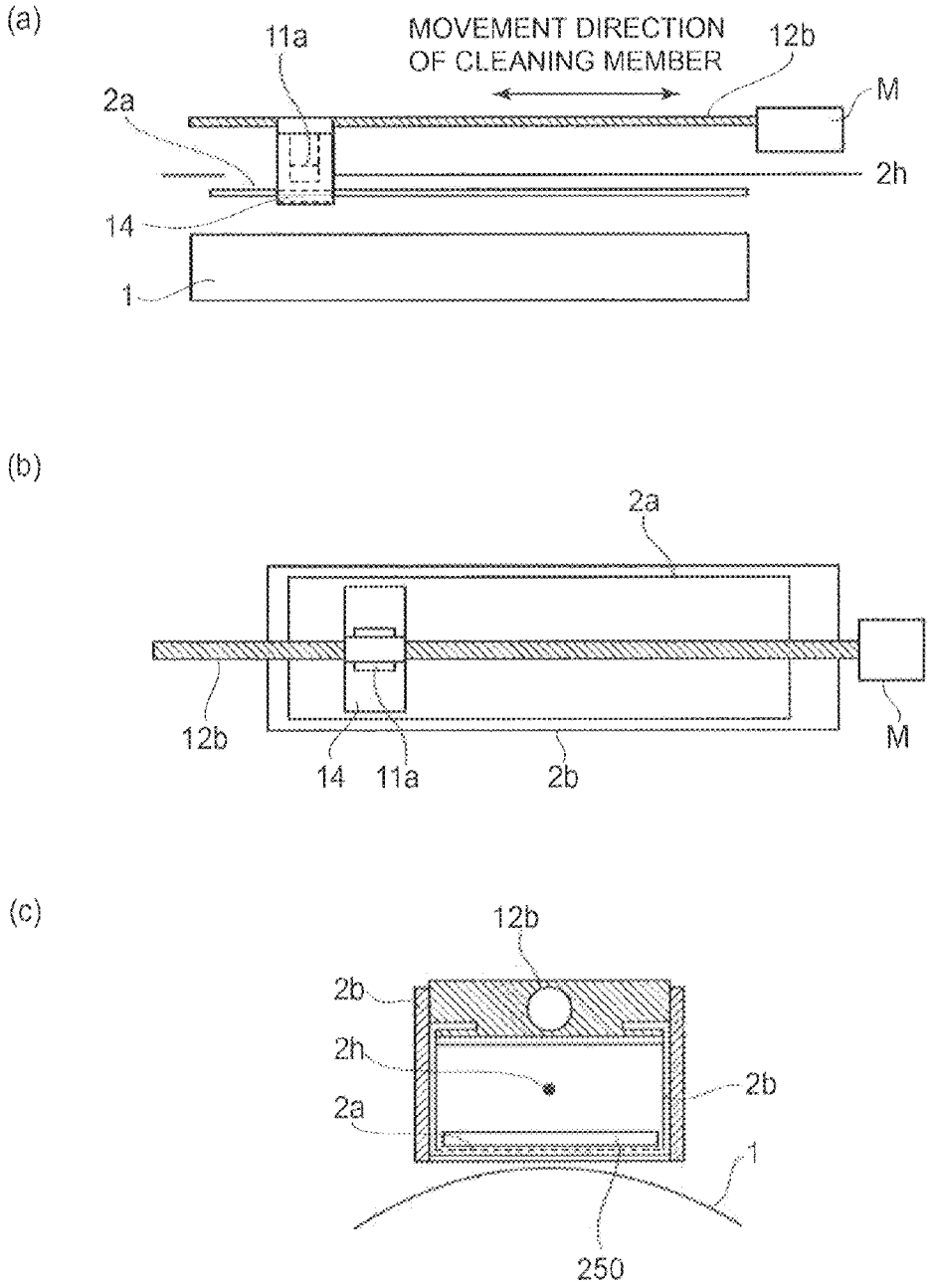
FIG. 2 includes schematic views showing an outer appearance of a corona charger according to the embodiment.
Figure 3:
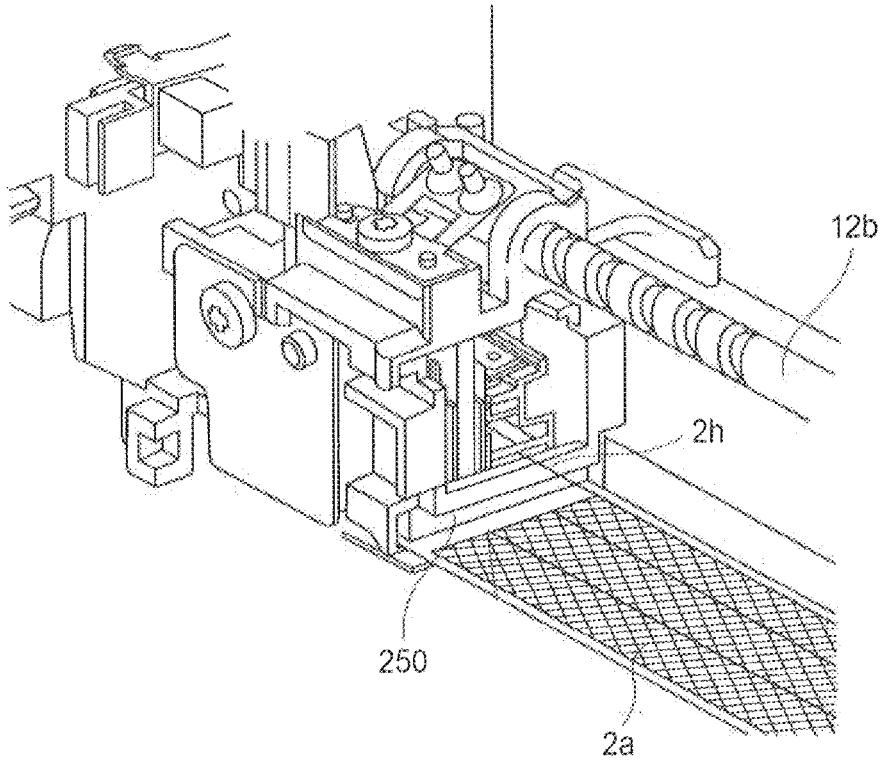
FIG. 3 includes perspective views of the corona charger according to the embodiment.
Figure 3:
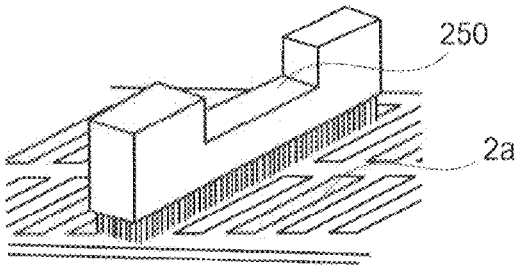
Figure 4:
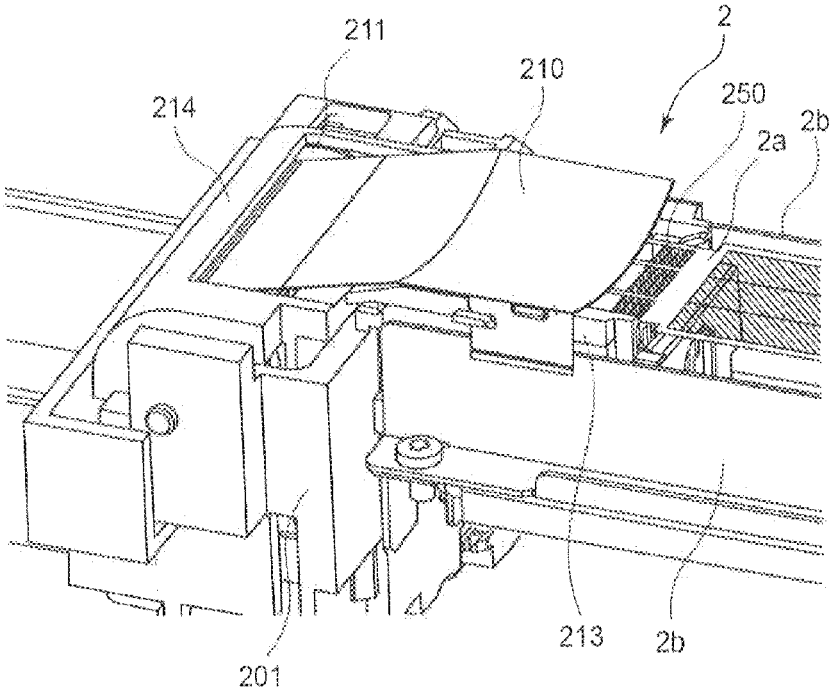
FIG. 4 is an enlarged view of the corona charger according to the embodiment in the neighborhood of a shutter accommodating portion.

Description will be made specifically using FIG. 2. In FIG. 2, (a), (b) and (c) are a side view, a bird's-eye view and a sectional view of the corona charger, respectively. In FIG. 3, (a) is a perspective view of the corona charger.

As shown in (c) of FIG. 2, the corona charger 2 includes a discharging wire 2*h*, a casing including a U-character-shaped shield 2*b* provided so as to surround this discharging wire 2*h*, and a grid 2*a* which is a grid electrode as a control electrode provided in an opening of the casing (scorotron type). In this embodiment, in a photosensitive member side (member-to-be-charged side) than the discharging wire 2*h*, as the grid 2*a* stretched in a longitudinal direction of the corona charger, a flat plate-like edging grid was used. Incidentally, the discharging wire 2*h* is stretched inside the shield 2*b* with respect to the longitudinal direction of the corona charger.

Further, to the discharging wire 2*h* of the corona charger 2, a high(-voltage) voltage is applied from an unshown high-voltage source. Similarly, to the grid 2*a*, a high voltage is applied from an unshown another high-voltage source. Incidentally, as is apparent from also the side view of (a) of FIG. 2, the corona charger 2 is provided along a generatrix line of the photosensitive drum 1, and the longitudinal direction of the corona charger 2 is in a parallel relationship with an axial line of the photosensitive drum 1. By applying a predetermined voltage to the grid which is the grid electrode as the control electrode, a current flowing from the discharging wire into the photosensitive member is controlled, so that a charge potential of the photosensitive member can be converted to a desired potential.

As the discharging wire 2*h*, stainless steel, nickel, molybdenum, tungsten or the like may preferably be used. In this embodiment, tungsten having very high stability among metals was used as the discharging wire 2*h*. Further, a diameter of the discharging wire may preferably be 40 μm to 100 μm. In this embodiment, as the discharging wire 2*h*, the tungsten wire of 60 μm in diameter was used. As a base material of the grid 2*a*, a material having the mesh portion (opening) formed on an about 0.03 mm-thick thin plate-like metal plate, of austenitic stainless steel (SUS 304) by etching to provide many through holes was used. Further, on the SUS constituting the base material, a protective layer was formed with a material high in chemical inertness toward an electric discharge product generated by the corona discharge. Specifically, the protective layer (surface layer) was formed by vapor deposition of tetrahedral amorphous carbon (hereinafter referred to as ta-C).

Incidentally, in this embodiment, the base material is not limited to the base materials shown above, but another austenitic stainless steel, martensite stainless steel or ferrite-based stainless steel or the like may also be used. The ta-C used for the surface layer in the present invention is one species of DLC (diamond like carbon) in general. The DLC has an amorphous structure in which diamond bond (sp3 bond) containing hydrogen in some amount in general and graphite bond (sp2 bond) are co-present.

(About Cleaning Member)

The cleaning member for cleaning the discharging wire as the discharge electrode and the grid which is the grid electrode as the control electrode will be described. As shown in (a) of FIG. 2 and (b) of FIG. 2, the corona charger in this embodiment includes a cleaning pad 11*a* for cleaning the discharging wire 2*h*. Further, the corona charger includes a grid cleaning member 250 as the cleaning member for cleaning the grid 2*a*.

The cleaning pad 11*a* and the grid cleaning member 250 are moved in the longitudinal direction of the corona charger by a screw 12*b* which is a driving member rotating by receiving drive of a driving motor M. As shown in (b) of FIG. 3, the grid cleaning member 250 for cleaning the grid 2*a* cleans the grid 2*a* in contact with a surface of the grid 2*a* in the discharging wire side.

In this embodiment, the cleaning pad 11*a* as a wire cleaning member was provided so as to sandwich the wire 2*h* from both sides by using a sponge. Further, as the grid cleaning member 250 as the cleaning member for the grid, a member in which an acrylic brush is subjected to flame-retardant treatment and then is woven in a base cloth was used. Incidentally, in addition to this, members of nylon, PVC (polyvinyl chloride), PPS (polyphenylene sulfide resin) or the like may also be used. Further, the material is not limited to a material of a fiber-planted type, but may also use a pad (elastic member) such as a felt or a sponge, or a sheet on which an abrasive such as alumina or silicon carbide is applied.

(About Shutter and Shutter Accommodating Portion)

The shutter 210 and a constitution for winding up and accommodating the shutter 210 will be described using FIG. 3.

The corona charger 2 includes the sheet-like shutter 210 for shielding the opening (width: about 360 mm) where the casing having the shield 2*b* opposes the photosensitive drum 1. The shutter 210 moves in a gap between the grid 2*a* and the photosensitive drum 1 to open and close the opening of the casing. A width of the shutter 210 with respect to a short direction is larger than a width of the corona charger 2 with respect to the short direction. Incidentally, the shielding of the opening may only be required that the opening is shielded substantially with respect to a direction in which the opening opposes the photosensitive member, and also includes the case where there is a gap due to tolerance of mounting of the shutter. As the shutter 210 in this embodiment, a nonwoven fabric formed of rayon in a thickness of 20 μm was used. The material for the shutter 210 may be any material of the shutter 210 has a sheet shape, and a material of woven nylon fibers and a film using urethane or polyester may also be used.

The shutter 210 is wound up in a roll shape and accommodated at an end portion of the corona charger 2 with respect to the longitudinal direction by a winding-up mechanism 211 for winding up the shutter. This winding-up mechanism 211 includes a roller by which a shutter end portion is fixed and a torsion coil spring for urging the roller. The shutter 210 is urged by the torsion coil spring in a shutter winding-up direction (opening open direction), and as a result, a longitudinal central portion of the shutter does not readily sag. The winding-up mechanism 211 is held, by the front block 201, together with a holding case 214 for holding the winding-up mechanism 211. In the neighborhood of a shutter pulling-out portion of the holding case 214, a guiding roller 215 for guiding the shutter 210 in order that the shutter 210 does not contact an edge of the grid 2*a*, the stretching portion, a knob thereof, and the like is provided.

Further, the other end of the shutter 210 with respect to the longitudinal direction is fixed to a leaf spring 17 as a shutter fixing member. The leaf spring 17 holds the shutter and pulls the shutter in a closing direction, and also provides stiffness to the shutter by regulating the sheet-like shutter in the arch shape. Specifically, the central portion of the shutter with respect to the short direction is regulated by the leaf spring 17 so as to have a convex shape toward the discharging wire side.

Further, the leaf spring 17, as a pulling member and also as a regulating member, for holding the neighborhood of the leading end of the shutter 210 is connected to a carriage 213 as a movable member. Incidentally, in this embodiment, the thickness of the shutter 210 is 0.15 mm, and as the leaf spring 17, a metal material of 0.10 mm in thickness was used.

When the carriage 213 is moved toward a rear side (opening closing direction) by receiving rotational drive from the screw 12*b* as the driving member provided at an upper portion of the corona charger, the shutter 210 is pulled out from the winding-up mechanism 211. Further, when the carriage 213 moves toward a front side (opening open direction), the shutter 210 is wound up by the winding-up mechanism 211 and is accommodated in the holding case 214. At that time, the cleaning pad 11*a* and the grid cleaning member 250 are also driven simultaneously. In this embodiment, the shutter 210 and the grid cleaning member 250 are driven by a single screw 12*b*, and therefore the shutter 210 and the grid cleaning member 250 operate in interrelation with each other. If a plurality of driving sources are provided, it would be considered that a constitution in which the shutter 210 and the grid driving member 250 are driven independently of each other is employed, but when cost reduction is taken into consideration, it is preferable that the interrelation constitution as in this embodiment is employed.

3. About Opening and Closing Control of Shutter

In the following, control for opening and closing the opening of the corona charger in this embodiment by the shutter will be described.

(About Opening and Closing Control of Shutter)

Figure 5:
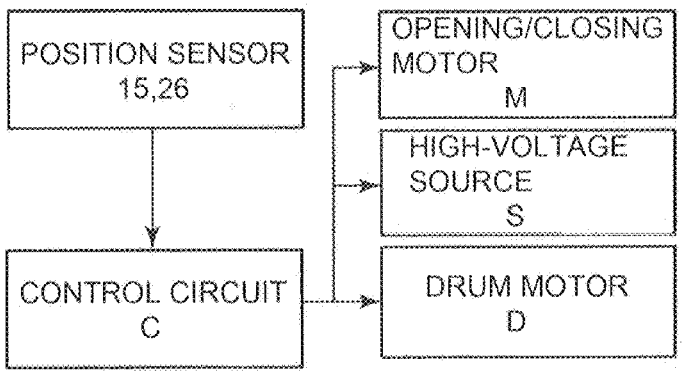
FIG. 5 includes schematic views for illustrating shutter opening and closing control of the corona charger according to the embodiment.
Figure 5:
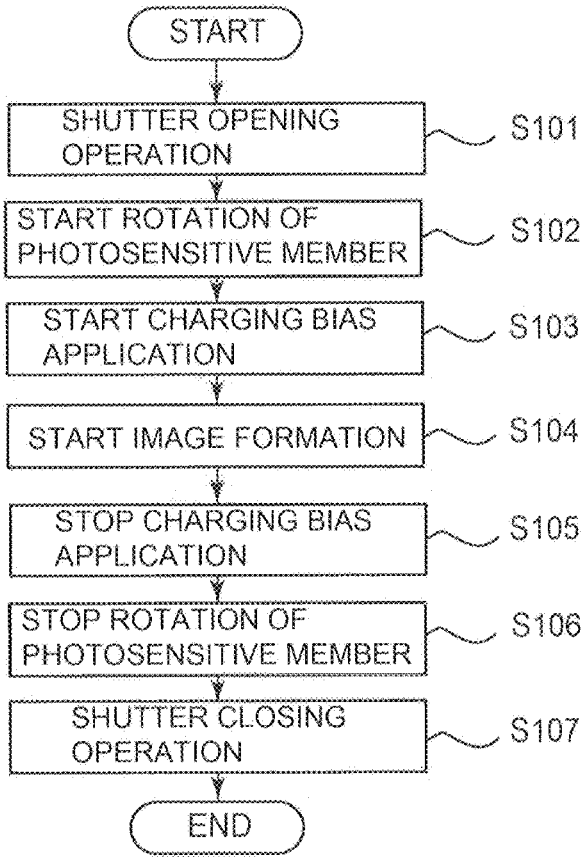

Opening and closing control of the shutter will be briefly described. In FIG. 5, (a) is a block diagram for schematically illustrating a control circuit, and (b) of FIG. 5 is a flowchart for illustrating the contents of control. As shown in (a) of FIG. 5, a control circuit (controller) C as a control means controls, in accordance with a problem held therein, the driving motor M as the driving source, a high-voltage sources, and a drum motor D. Further, position sensors 15 and 26 notify the control circuit of presence or absence of the flag.

In the following, an operation of the corona charger during the image forming operation will be described using a flowchart. The control circuit C receives an image forming signal and then moves, on the basis of an output of the position sensor 15, the shutter 210 so as to open the opening by driving the driving motor M in the case where the shutter 210 is in the closed state, and then confirms, by the position sensor 15, that the shutter 210 opened (S101). Then, in a state in which the shutter 210 is retracted (the opening opens), the control circuit C drives the drum motor D to rotate the photosensitive drum 1 (S102). Further, in order to charge the photosensitive drum, the control circuit C effects control so that the charging bias is applied from the high-voltage source S to the discharging wire 2*h* and the grid 2*a* (S103).

Other image forming portions are caused to act on the photosensitive drums 1 charged by the corona charger 2, so that the images are formed on the sheet (S104). After an end of the image formation, the control circuit C stops the application of the charging bias to the corona charger 2 (S105), and then stops the rotation of the photosensitive drum 1 (S106). After the step of the photosensitive member 1 rotation, the control circuit C reversely rotates the driving motor M to execute an operation in which the opening is closed by the shutter (S107). Incidentally, the closing operation of the shutter 210 may be performed immediately after the image formation or may also be carried out after a lapse of a predetermined time from the end of the image formation.

4. About Positional Relationship of Shutter and Cleaning Member

In the following, a relationship of the shutter and the cleaning member will be described using a sectional view. First, a moving mechanism for moving the shutter and the cleaning member for cleaning the grid in this embodiment in the longitudinal of the opening will be described. Thereafter, the position relationship of the shutter and the cleaning member when the shutter opens and closes the will be described using the sectional view.

(About Shutter Moving Mechanism)

Figure 6:
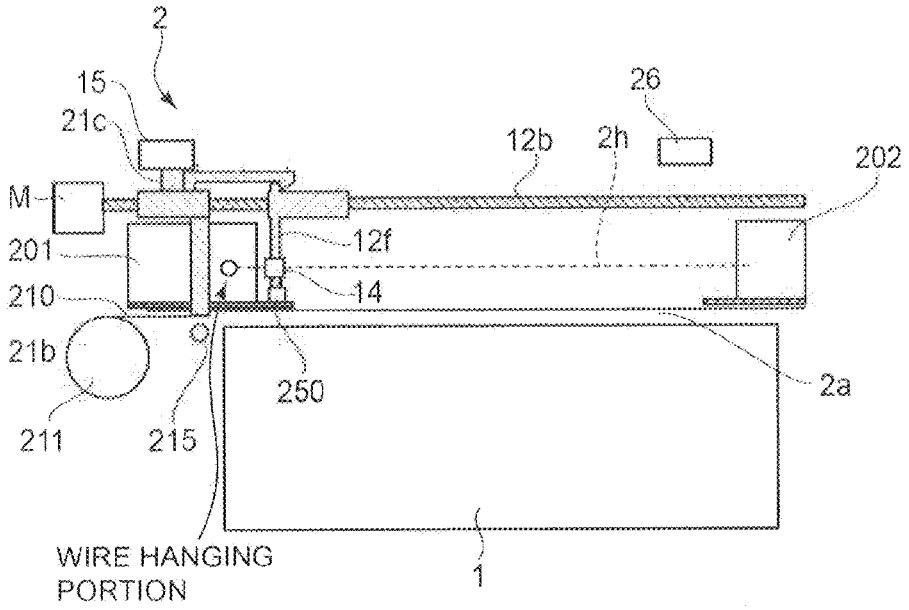
FIG. 6 is a schematic view showing a state in which a shutter according to the embodiment opens.
Figure 7:
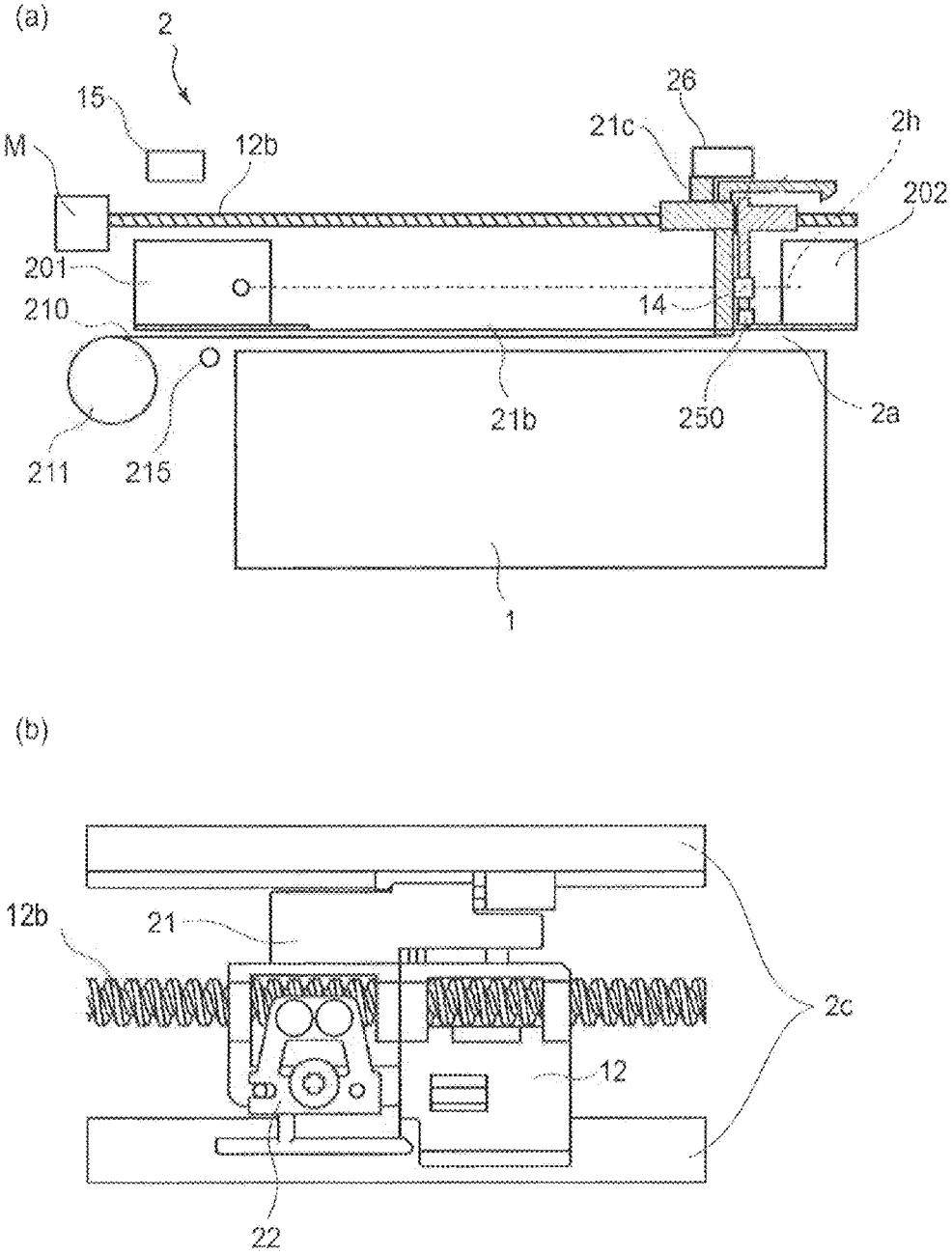
FIG. 7 includes schematic views showing a shutter closing operation according to the embodiment.

The moving mechanism for the shutter 210 will be described. FIG. 6 and FIG. 7 shows an open state and a closed state of the shutter, FIG. 8 is a perspective view showing details of the moving mechanism, and FIG. 9 shows a sectional view of the corona charger as seen from one longitudinal end side.

This moving mechanism includes the driving motor M as the driving source, the winding-up mechanism 211, a first moving member 21 for holding the shutter 210, a second moving member 12 for holding the grid cleaning member 250, and the screw 12*b* as the driving member. Incidentally, in this embodiment, the driving motor M is included as a driving mechanism for the charging device, but a constitution in which the driving motor M is provided outside the charging device in the image forming apparatus may also be employed, and in this case, the driving motor M is not included in the moving mechanism. By these, the shutter 210 is opening/closing-moved along the longitudinal direction (main scanning direction) thereof. Further, as shown in FIG. 6, a shutter opening detecting device 15 for detecting opening operation completion of the shutter 210 and a shutter closing detecting device 26 for detecting closing operation completion of the shutter 210 are provided.

This shutter opening detecting device 15 and the shutter closing detecting device 26 include photo-interruptors. Further, when the first moving member 21 reaches an opening operation completion position and a closing operation completion position, the photo-interruptors 15 and 26 are shielded by a light-blocking member 21*c*. As a result, the photo-interruptors 15 and 26 have a mechanism for detecting opening operation completion and closing operation completion of the shutter 210. That is, a constitution in which the rotation of the driving motor M is stepped at the time when the light-blocking member 21*c* of the moving member 21 is detected by the shutter opening detecting device 15 and the shutter closing detecting device is employed.

Figure 8:
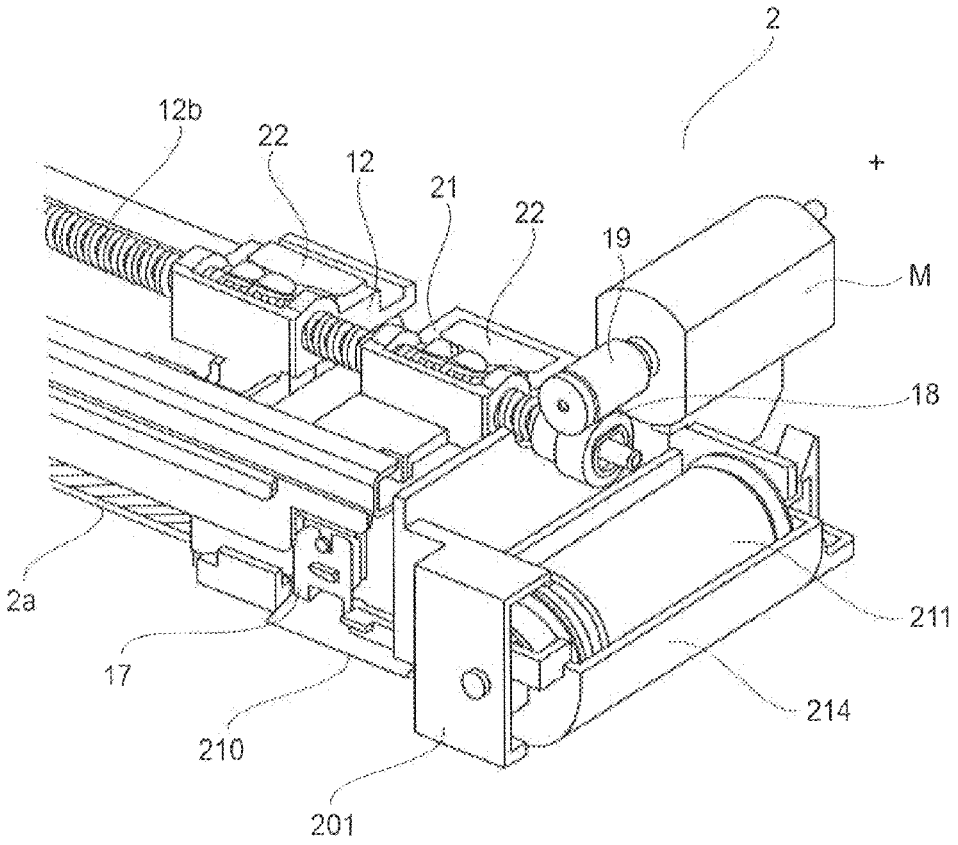
FIG. 8 is a schematic view showing an opening and closing mechanism for the shutter according to the embodiment.
Figure 9:
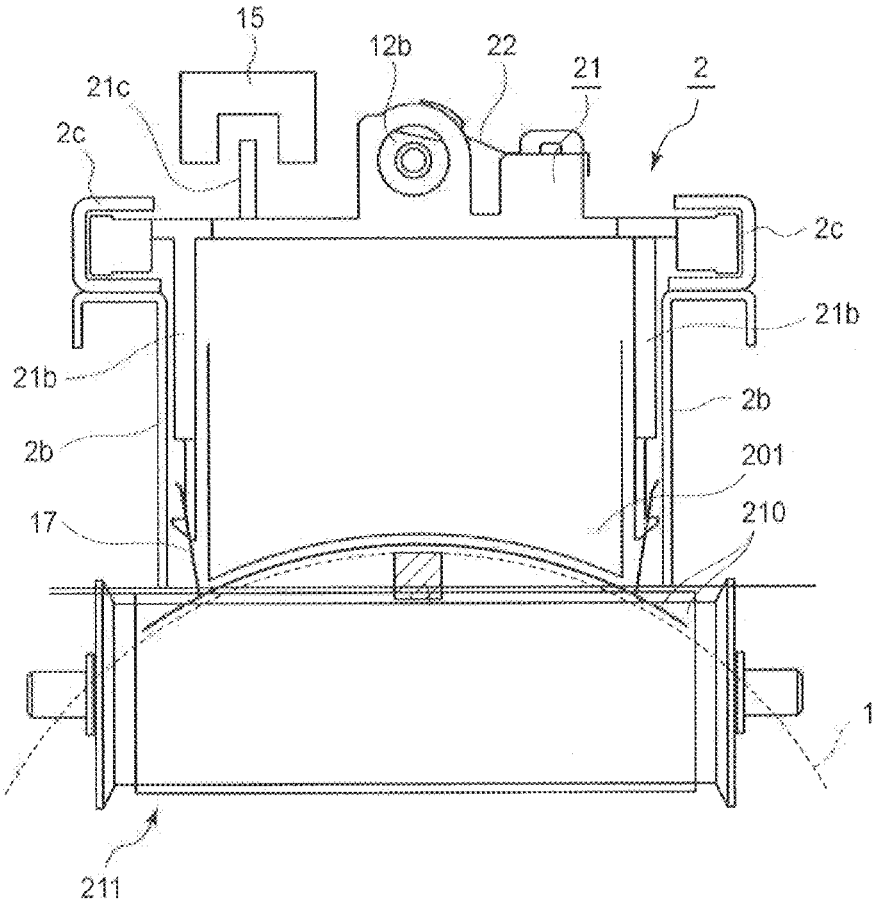
FIG. 9 is a schematic view showing a sheet direction of a charging device according to the embodiment.

As shown in FIG. 8 and FIG. 9, in a leading end side of the shutter 210 with respect to the closing direction, a shutter fixing member 17 functioning as a regulating means for regulating a shape of the shutter 210 so that a central portion of the shutter with respect to the short direction projects toward the corona charger side more than both end portions of the shutter project toward the corona charger. This shutter fixing member 17 is locked and fixed to a connecting member 21*b* provided integrally with the first moving member 21. Further, the first moving member 21 includes a drive transmitting member 22 as a holding portion threadably mounted on the screw 12*b*, and is drive-connected with the screw 12*b* as the driving member via this drive transmitting member 22. This drive transmitting member 22 is provided also on the second moving member 12 although it is not shown in the figures, and also the second moving member 12 is drive-connected with the screw 12*b* via the drive transmitting member 22. Further, the first moving member 21 and the second moving member 12 are threadably mounted so that they can move only in the main scanning direction on a rail 2*c* provided on the corona charger 2, so that the first moving member 21 and the second moving member 12 are prevented from rotating together with the screw 12*b*.

As shown in FIG. 6 and FIG. 8, on the screw 12*b*, a spiral groove is formed, and a gear 18 is connected with the screw 12*b* at one end portion of the screw 12*b*. On the other hand, a warm gear 19 is connected with a free end of the driving motor M, and a driving force of the driving motor M is transmitted to the screw 12*b* via an engaging portion between the warm gear 19 and the gear 18. Then, when the screw 12*b* is rotationally driven by the driving motor M, the first moving member 21 moves in the main scanning direction along this spiral groove. Accordingly, a constitution in which when the screw 12*b* is driven by the driving motor M, a moving force in an opening and closing direction is transmitted to the shutter 210 via the connecting member 21*b* provided integrally with the first moving member 21 is employed.

The second moving member 12 integrally includes a cleaning pad 14 for cleaning the discharging wire 2*h* and a connecting member 12*f* for holding the grid cleaning member 250 as the cleaning member. Accordingly, simultaneously with movement of the shutter 210 in the main assembly direction (X, Y directions) by the driving motor M as described above, the cleaning pad 14 and the grid cleaning member 250 also move in the same direction. By this, the cleaning pad 14 for cleaning the discharging wire 2*h*, the grid cleaning member 250 for cleaning the grid 2*a*, and the shutter 210 can be driven by the same driving motor M.

(About Opening and Closing Operation of Shutter and Positional Relationship Among Respective Members)

Figure 10:
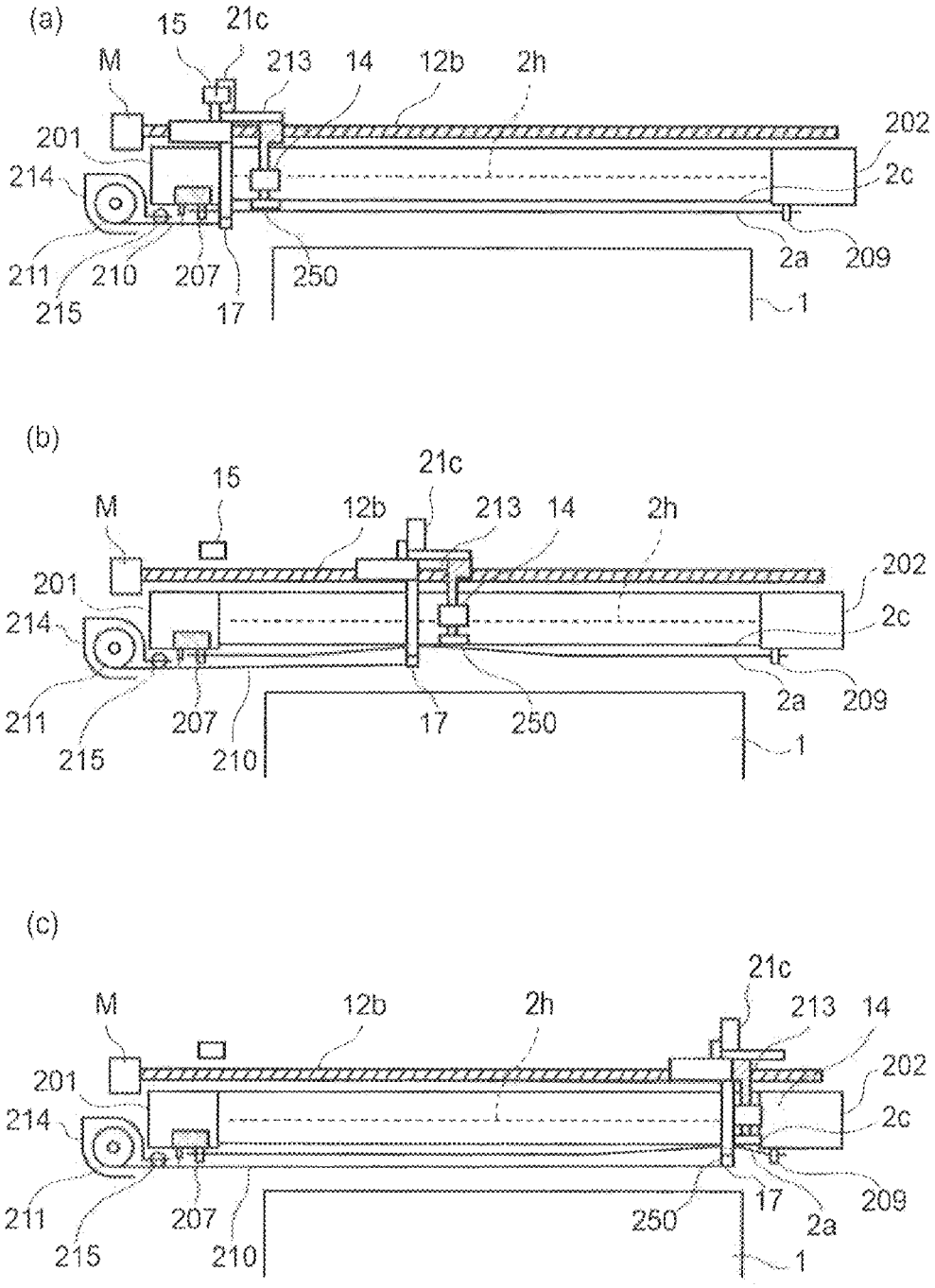
FIG. 10 includes side views of the corona charger according to the embodiment during a shutter opening and closing operation.

In FIG. 10, (a) is a side view of the corona charger 2 in a state in which the carriage 213 is in a home position. The cleaning member 250 is held by the second moving member 12 and move as a unit in the longitudinal direction of the corona charger 2. In the state (shutter open state) of (a) of FIG. 10, the grid 2*a* is stretched substantially in parallel to the photosensitive drum 1. Further, an interval between the grid 2*a* and the photosensitive drum 1*a* is about 1.0-1.5 mm at a substantially central close portion. Incidentally, in this embodiment, the substantially parallel state between the grid 2*a* and the photosensitive drum 1 refers to that a beam line of the grid 2*a* and the generatrix of the drum-shaped photosensitive drum 1 is not more than 3 degrees.

Here, a leading end portion (one end with respect to the closing direction) of the shutter 210 is thick correspondingly to a thickness of the shutter fixing member 17 consisting of, e.g., a leaf spring for drawing the shutter 210. Naturally, it is possible to pass the leaf spring portion through a gap (about 1 mm) between the photosensitive drum 1 and the grid 2*a* by enhancing assembly accuracy, but an increase in cost is caused. Even when an assembly error of the corona charger 2 is taken into consideration, when the shutter fixing member 17 and the grid 2*a* are caused to slide with each other in place of a non-contact state of the shutter fixing member 17 with the photosensitive drum 1, the shutter 210 is liable to slide with the grid 2*a* and therefore is undesirable. Especially, in the case where an etching grid in which a thin plate-shaped grid 2*a* is provided with a plurality of openings is used, when the opening and closing operation of the shutter 210 is performed in a state in which the gap between the photosensitive drum 1 and the grid 2*a* is narrow, there is a possibility that a thick portion of the shutter fixing member 17 is caught by the grid.

Therefore, in the corona charger in this embodiment, in order to cause the shutter fixing member 17 for drawing the leading end portion of the shutter 210 to less contact the grid 2*a*, a mechanism for pulling and retracting the grid 2*a* in the discharging wire 2*h* side is provided on the second moving member 12. As shown in (b) of FIG. 10, during movement of the grid cleaning member 250, the grid 2*a* is retracted, so that it is possible to suppress sliding of the shutter fixing member 17 and the shutter 210 with the grid 2*a*. Incidentally, the shutter fixing member 17 moves between grid stretching portions 207 and 209, and therefore the grid can smoothly deform in the discharging wire side. By retracting the grid 2*a* in the discharging wire 2*h* side, the grid cleaning member 250 and the grid 2*a* contact each other in the predetermined amount, so that the grid 2*a* is capable of being cleaned by the grid cleaning member 250.

Next, a state in which the shutter 210 opens will be described. As shown in FIG. 6, the driving motor M operates until the shutter opening detecting device 15 reacts, and then the shutter opening detecting device 15 reacts and the shutter 210 steps. At that time, the shutter 210 steps while maintaining a predetermined distance between the second moving member 12 and the shutter 210 in the state in which the shutter 210 opens. The distance between the second moving member 12 and the shutter 210 in the state in which the shutter 210 opens has no influence on the effect of the present invention, and therefore may be any value.

The case where the distance between the second moving member 12 and the shutter 210 when the shutter 210 is opened (during start of opening operation) is smaller than the distance between the second moving member 12 and the shutter 210 in the state in which the shutter 210 opens (opening open state) will be described. As shown in FIG. 6, the driving motor M operates until the shutter opening detecting device 15 reacts, but the second moving member 12 abuts against a front block 201 as a stepper, so that only the second moving member 12 steps. Here, the screw 12*b* rotates and drive transmission to the second moving member 12 is made through the driven transmitting member 22, but the second moving member 12 abuts at the front block, and therefore the drive transmitting member 22 having the leaf spring shape is disconnected from the rotating screw 12*b*, so that the drive is not transmitted to the second moving member 12. Thereafter, to the shutter 210, similarly via the first moving member 21 including the drive transmitting member 22, the drive is transmitted from the screw 12*b*, and therefore the shutter 210 continues movement, and the driving motor operates until the shutter opening detecting device reacts, so that the shutter opening detecting device 15 reacts and thus the shutter 210 steps. By this, in the state (shutter open state) of FIG. 6, a state in which the distance between the shutter 210 and the second moving member 12 is increased is created.

Next, an operation when the shutter 210 is closed will be described. When the shutter 210 is closed, in the case where the shutter 210 is moved while keeping the distance between the shutter 210 and the second moving member 12 in the closed state, it would be considered that a foreign matter removed by the grid cleaning member 250 drops onto the shutter 210. Therefore, as shown in (b) of FIG. 10, by moving the shutter 210 while keeping the distance between the shutter 210 and the second moving member 12 in the open state, the drop of the foreign matter, removed by the grid cleaning member 250, onto the shutter 210 is suppressed. However, in this case, when the shutter 210 is closed, as shown in (d) of FIG. 11, there is a need to enlarge the charging device in order to cover the entire area of the opening with the shutter 210.

Figure 11:
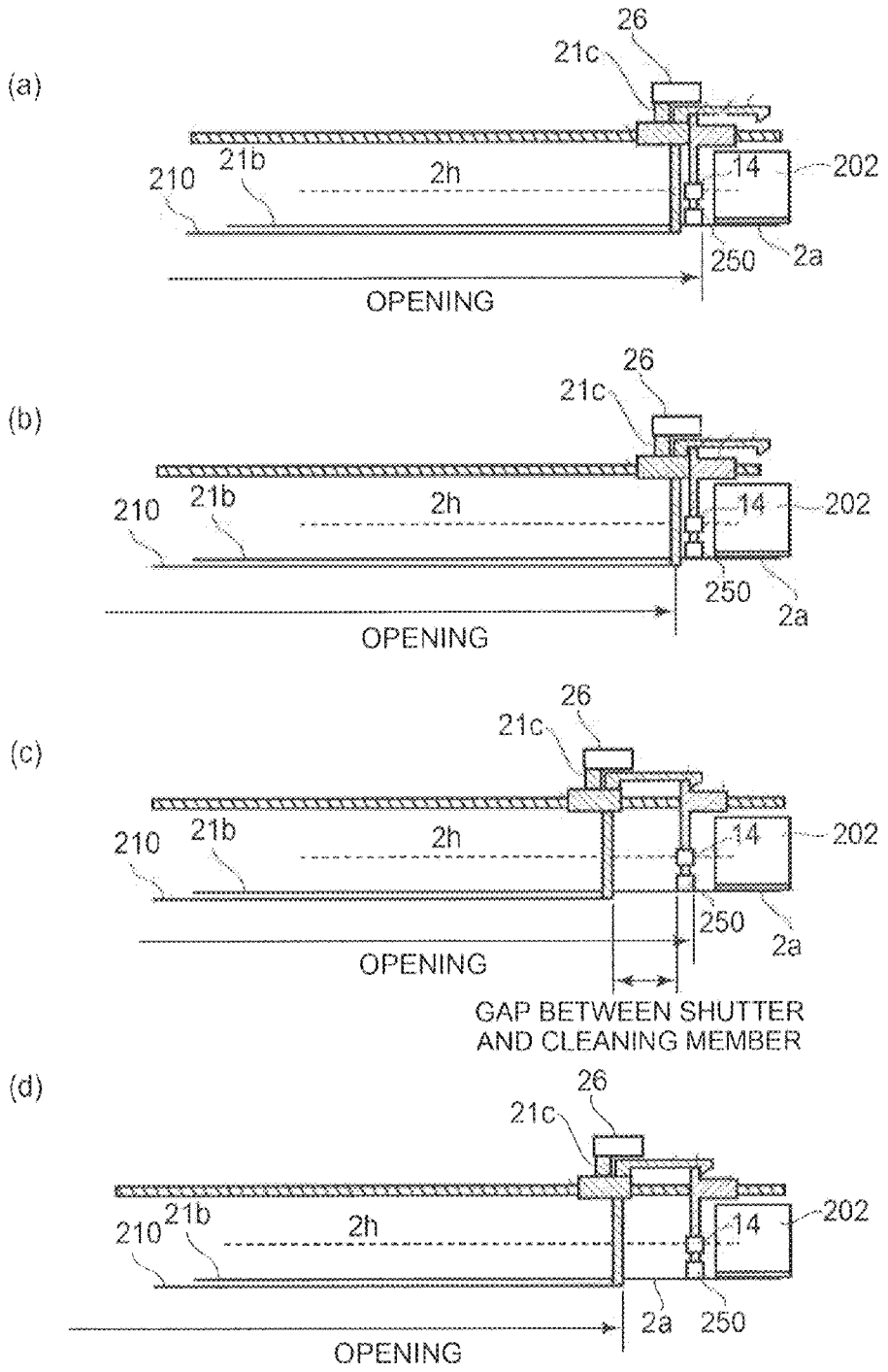
FIG. 11 includes schematic views showing a closed state of the shutter according to the embodiment.

Here, as shown in (c) of FIG. 11, in the case where the size of the charging device is not changed, there is a possibility that the electric discharge product drops from the interval between the shutter 210 and the second moving member 12 onto the photosensitive drum, and thus the image flow generates. In the case where the distance between the shutter 210 and the second moving member 12 is closed during end of the movement of the shutter 210 in the closing direction, in order to cover the entire area of the grid opening with the shutter 210, the size of the charging device is increased correspondingly to the size of the grid cleaning member 250.

Therefore, as in this embodiment, when the shutter 210 completes the movement in the closing direction, as shown in (a) of FIG. 11, in the case where the opening is covered with the shutter 210 and the grid cleaning member 250, it becomes possible to further decrease the charging device in size.

That is, when the shutter 210 is closed, the distance between the shutter 210 and the cleaning member 250 is closed, and the opening is covered with the shutter 210 and the grid cleaning member 250, so that it becomes possible to cover the entire area of the grid opening without increasing the charging device in size.

Incidentally, the distance between the shutter 210 and the grid cleaning member 250 may preferably be 0, but when the position accuracy and the effect of the present invention are taken into consideration, the shutter leading end may overlap with a part of the grid cleaning member 250. By this, an amount of the electric discharge product dropping from above the grid onto the photosensitive drum is suppressed, so that the image flow standing is prevented.

When the shutter 210 is closed, the driving motor M rotates until the light-blocking member 21*c* of the first moving member 21 is detected by the shutter closing detecting device 26. However, the second moving member 12 abuts against the rear block 202 as the stepper for the charging device, and therefore the drive transmitting member 22 having the leaf spring shape is disconnected from the groove of the rotating screw 12*b*, and thus the drive is not transmitted, so that the second moving member 12 steps earlier than the shutter 210. Thereafter, the shutter 210 continues the movement until the shutter closing detecting device 26 detects that the shutter 210 is closed, and therefore in the shutter closing state, it is possible to shield the entire area of the opening by both the grid cleaning member 250 provided on the second moving member 12, and the shutter member.

Next, an operation when the shutter moves in an opening direction will be described. The shutter 210 moves while keeping the distance between the shutter 210 and the cleaning member 250 in the closed state. In this embodiment, when the shutter moves in the opening direction, the distance between the shutter 210 and the cleaning member 250 is in the closed state, but may also be in the opened state.

[Embodiment 2]

In this embodiment, basic structures of an image forming apparatus and a corona charger 2 and an operation flow of a shutter 210 are similar to those in Embodiment 1, and in this embodiment, when the shutter 210 moves in the closing direction, the movement is made by spacing the grid cleaning member 250 and the leading end of the shutter 210 with a predetermined distance, and an operation is performed so that the shutter 210 and the grid cleaning member 250 at least partly overlap with each other when the shutter 210 reaches a closing operation completion position.

(About Driving Mechanism for Shutter and Cleaning Member)

Figure 12:
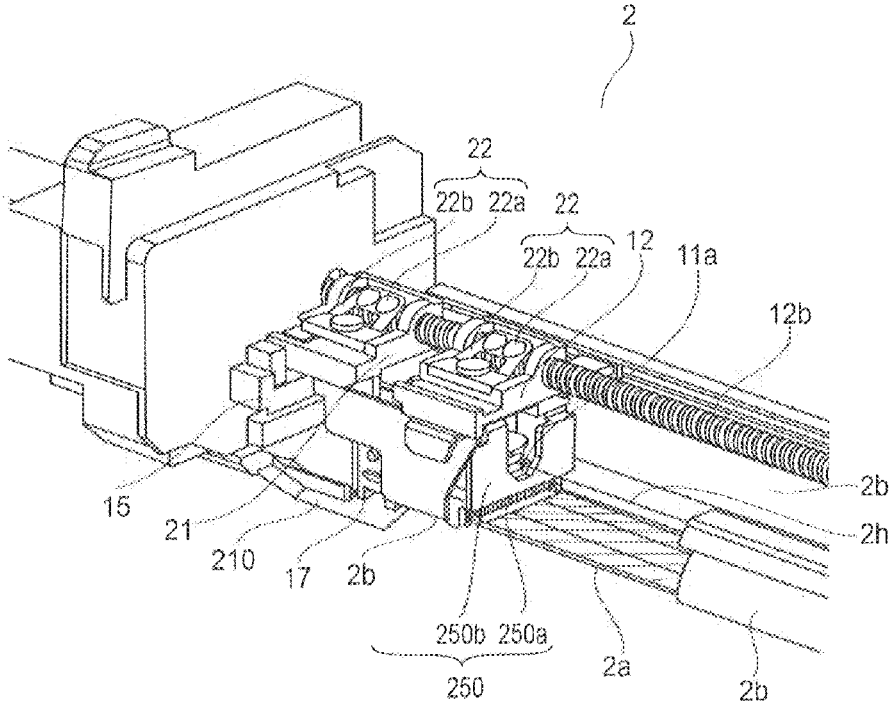
FIG. 12 is a perspective view of the corona charger according to an embodiment in the neighborhood of a device front side.

An opening and closing mechanism for the shutter and a moving mechanism for the cleaning member in this embodiment will be described. Also in this embodiment, in order to transmit drive of the first moving member and the second moving member with the screw 12*b*, each of the first moving member 21 and the second moving member 12 is provided with a drive transmitting means 22 as a holding portion capable of independently switching transmission and elimination (idling) of a driving force. Specifically, as shown in FIG. 8 and FIG. 12, the drive transmitting means 22 engages with a spiral groove of the screw 12*b* at an outer peripheral portion of the screw 12*b*, and is connected with each of the first moving member 21 and the second moving member 12. The drive transmitting means 22 mounted on the first moving member 21 and the second moving member 12 use the same member.

Next, the transmission and elimination (idling) of the drive of the drive transmitting means 22 will be described. As shown in FIG. 12, the drive transmitting means 22 includes an engaging portion 22*a* for engaging with the spiral groove of the screw 12*b* and a pressing portion 22*b* for pressing the engaging portion 22*a* in a radial direction of the screw 12*b* at a predetermined force F.

Figure 13:
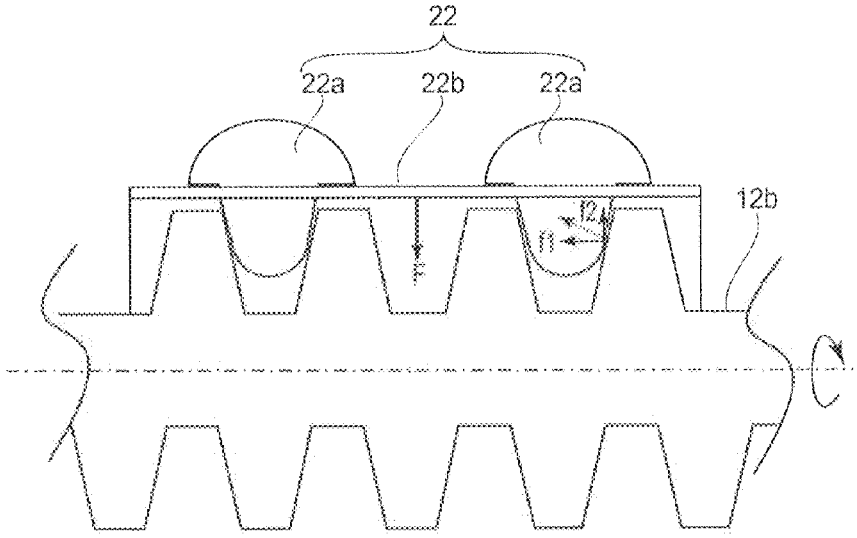
FIG. 13 is a schematic sectional view showing a driving mechanism of the corona charger according to the embodiment.

A schematic view showing a relationship between the screw 12*b* and the drive transmitting member 22 is shown in FIG. 13, and a force given to the drive transmitting member 22 by rotation of the screw 12*b* will be described. The screw 12*b* provides forces, in two directions, including a component force f1 in an axial direction of the screw 12*b* and a component force f2 in the radial direction of the screw 12*b* to the engaging portion 22*a* by the rotation thereof. In a normal state, the force F from the pressing portion is set so as to be larger than the component force f2 in the radial direction generated by the rotation of the screw 12*b*. By this, even when the screw 12*b* rotates, a state in which the engaging portion 22*a* engages with the spiral groove of the screw 12*b* is maintained, so that the first moving member 21 and the second moving member 22 on which the drive transmitting members 22 are mounted receive the component force f1 in the axial direction from the screw 12*b* and move in the axial direction.

On the other hand, in a state in which a large load is exerted when the first moving member 21 and the second moving member 12 are moved, e.g., in the case where the first moving member 21 and the second moving member 12 abut against end portions in a movable range, a load exerted on the engaging portion 22*a* becomes large, and correspondingly thereto, also the component force f2 in the radial direction of the screw 12*b* becomes large. When the component force f2 exerted in the radial direction is larger than the force F from the pressing portion 22*b*, the pressing portion is pushed up, so that the engaging portion 22*a* is disconnected from the spiral shape of the screw 12*b*. By this, even when the screw 12*b* rotates, the component f1 in the axial direction of the screw 12*b* is not transmitted to the first moving member 21 and the second moving member 12, so that the first moving member 21 and the second moving member 12 does not move in the axial direction of the screw 12*b*.

Even in the case where the first moving member 21 and the second moving member 12 abut against abutting member at the movable range end portions by the existence of the drive transmitting means 22, a load for rotating the screw 12*b* is not larger than a certain value, so that the screw 12*b* can rotate continuously. For that reason, even in the case where either one of the first moving member 21 and the second moving member 12 abuts against the movable range end portion early, it becomes possible to continuously move the other moving member.

(About Shutter/Grid Cleaning Operation)

Operations of the shutter 210 and the grid cleaning member 250 will be described. Cross-sections in the case where the shutter 210 exists at an opening operation completion position (home position) and the closing operation completion position are schematically shown in (a) and (b) of FIG. 14. Further, a halfway state of the closing operation of the shutter 210 is schematically shown in (a) of FIG. 15, and a halfway state of the opening operation of the shutter 210 is schematically shown in (b) of FIG. 15.

Figure 14:
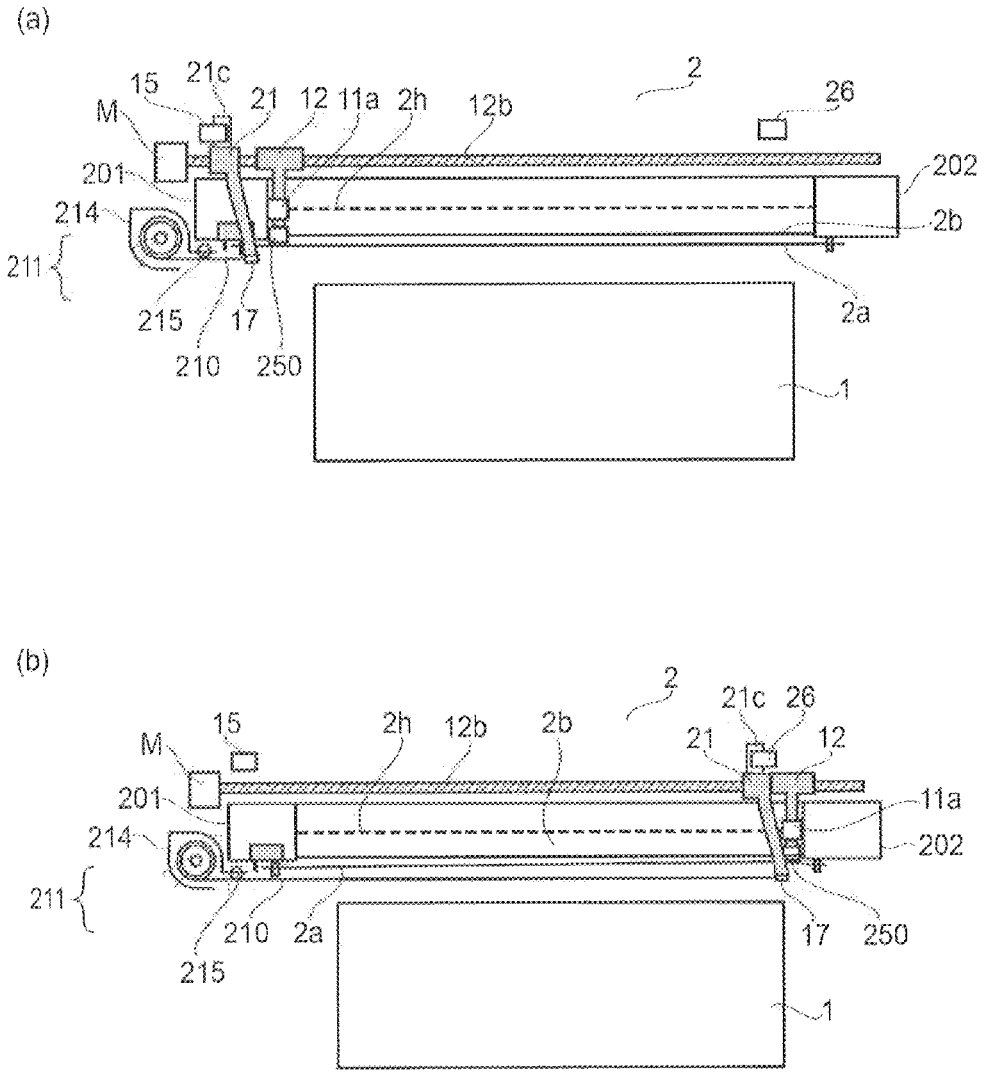
FIG. 14 includes schematic sectional views showing a shutter opening and closing operation completion position of the corona charger according to the embodiment.
Figure 15:
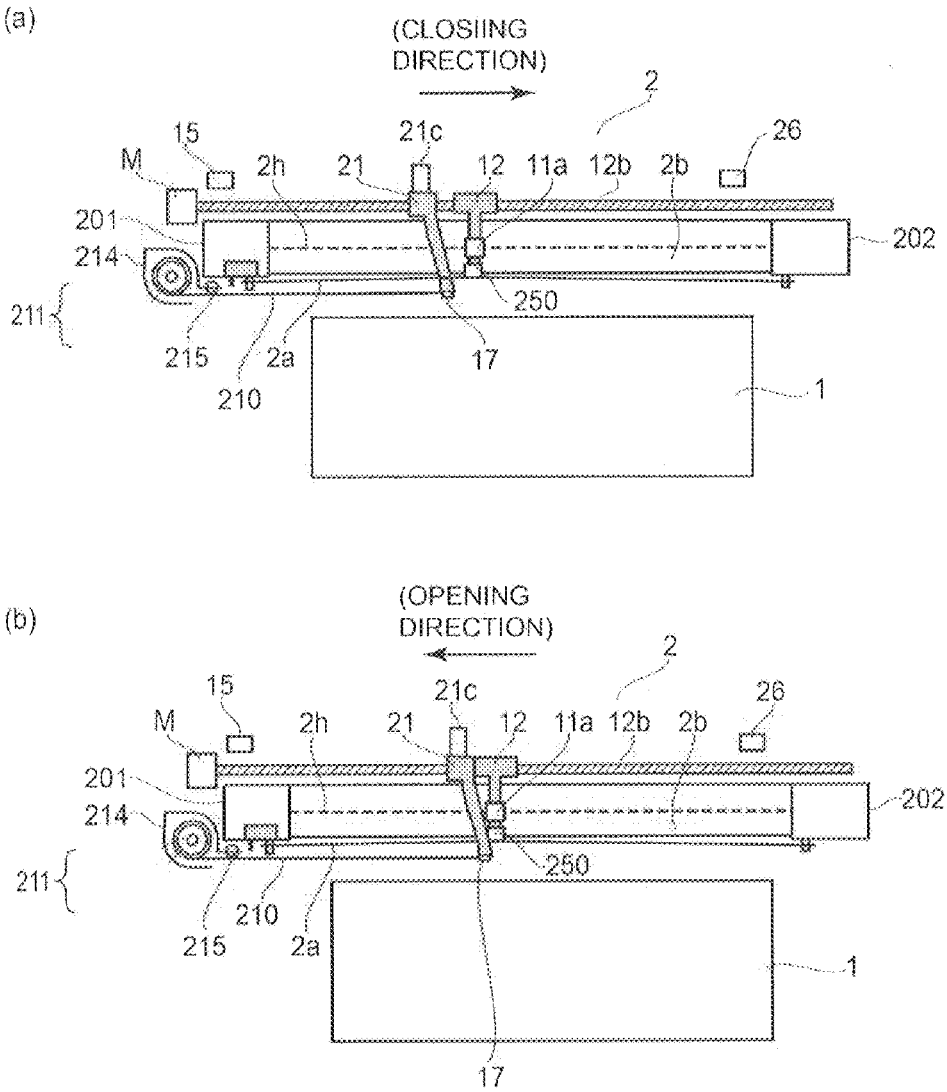
FIG. 15 includes schematic sectional views showing a shutter opening and closing operation of the corona charger according to the embodiment.

As shown in (a) of FIG. 14, when the shutter 210 and the grid cleaning member 250 exist at the home position, the first moving member 21 for moving the shutter 210 and the second moving member 12 for moving the grid cleaning member 250 are in stand-by in a mutually spaced state. At this time, the first moving member 21 is positioned in an upstream side relative to the second moving member 12 with respect to a closing operation direction of the shutter 210.

First, the closing operation of the shutter 210 will be described. When the shutter 210 starts the closing operation, a driving force is transmitted from the driving motor M to the screw 12*b*. The driving force from the screw 12*b* is transmitted simultaneously to both of the first moving member 21 and the second moving member 12, and therefore in the case where the closing operation of the shutter 210 is performed, the first moving member 21 and the second moving member 12 simultaneously start movement in the shutter closing direction. By this, in the halfway state in which the shutter 210 is closed, as shown in (a) of FIG. 15, the grid cleaning member 250 and the shutter 210 are to be operated while maintaining the position relationship at the home position. A state of the grid cleaning member 250 and the neighborhood of a leading end of the shutter 210 during the closing operation of the shutter 210 is schematically shown in (a) of FIG. 16. As shown in (a) of FIG. 16, during the closing operation of the shutter 210, brush portion free ends of the grid cleaning member 250 move toward the shutter 210 side while flexing. By this, the shutter 210 and the grid cleaning member 250 move while maintaining a distance D1 spaced in an amount not less than at least a degree of flexure of the grid cleaning member 250, so that it is possible to prevent the foreign matter on the grid 2*a* from dropping and depositing onto the neighborhood of the leading end of the shutter 210 by the grid cleaning.

Next, an operation immediately before the shutter 210 reaches the closing operation completion position will be described. In the closing operation of the shutter 210, setting is made so that the second moving member 12 reaches the movable range end portion early and thereafter the first moving member 21 reaches the closing operation completion position. By this, first, the second moving member 12 abuts against the movable range and portion, specifically the rear block 202 as the stepper, so that the drive transmitting means 22 eliminates the transmission of the driving force to the second moving member 12 and thus the screw 12*b* idles. Then, the grid cleaning is ended by the step of the grid cleaning member 250.

Also after the end of the grid cleaning, the first moving member 21 continues the movement, and when the leading end of the shutter 210 is in a position where the leading end overlaps with a part of the grid cleaning member 250 as shown in (b) of FIG. 14, detection that the shutter 210 reaches the closing operation completion position is made by the shutter closing detecting device 26. By the detection by the shutter closing detecting device 26, the driving motor M steps the rotation, so that the closing operation of the shutter 210 is ended. A state of the grid cleaning member 250 and the neighborhood of the leading end of the shutter 210 at the shutter closing completion position is schematically shown in (b) of FIG. 16. As shown in (b) of FIG. 16, after the grid cleaning is ended, the shutter 210 moves to a position where the shutter 210 overlaps with the grid cleaning member 250 by a distance D2, so that the opening of the corona charger 2 is shielded with no gap with respect to a direction in which the opening opposes the photosensitive drum.

Next, description of the opening operation of the shutter 210 will be made. The driving motor M rotates in a direction reverse to that during the closing operation of the shutter 210, thus rotating the screw 12*b* in a direction reverse to that during the closing operation. The driving force from the screw 12*b* is transmitted to both of the first moving member 21 and the second moving member 12 similarly as during the closing operation of the shutter 210, and therefore in the halfway state of the opening operation of the shutter 210, as shown in (b) of FIG. 15, the leading end of the shutter 210 and a part of the grid cleaning member 250 move in the shutter opening direction while maintaining the positional relationship similar to the closing operation completion position of the shutter 210.

Figure 16:
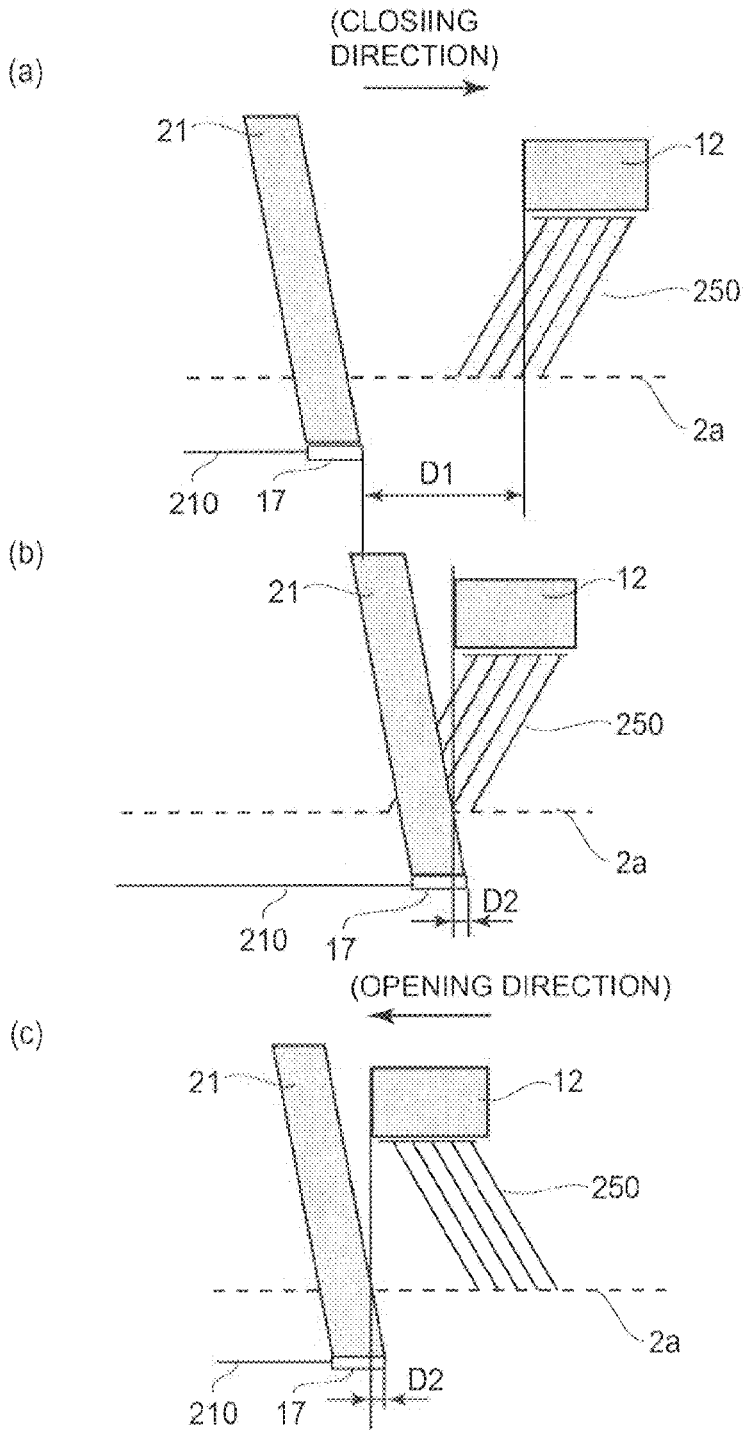
FIG. 16 includes enlarged views showing the shutter opening and closing operation of the corona charger according to the embodiment.

The grid cleaning member 250 and the neighborhood of the leading end of the shutter 210 during the opening operation of the shutter 210 are schematically shown in (c) of FIG. 16. As shown in (c) of FIG. 17, in the case where the shutter 210 performs the opening operation, the shutter 210 is in the upstream side with respect to the movement direction, so that a flexing direction of the grid cleaning member 250 is a direction in which the grid cleaning member 250 is spaced from the shutter 210. A possibility that the foreign matter to be dropped drops onto the shutter 210 by movement of the shutter 210 and the grid cleaning member 250 in the partly overlapping state by the distance D2 would be considered, but at a portion where the grid cleaning member 250 flexes in the spacing direction, there is no cleaning effect and therefore there is no problem even when the shutter 210 and the grid cleaning member 250 overlap with each other.

Next, an operation immediately before the shutter 210 reaches the opening completion position will be described. Similarly as in the closing operation of the shutter 210, also in the opening operation of the shutter 210, the second moving member 12 reaches the movable range end portion early and thereafter the first moving member 21 reaches the opening operation completion position. By this, first, the second moving member 12 abuts against the movable range and portion, specifically a front block 201 which is a second stepper, so that the drive transmitting means 22 eliminates the transmission of the driving force to the second moving member 12 and thus the screw 12*b* idles. Also thereafter, the first moving member 21 continues the movement, and the driving motor M steps the rotation by detection, by the shutter opening detecting device 15, such that the shutter 210 reaches the opening operation completion position, so that the opening operation of the shutter 210 is completed. As a result, a predetermined interval is formed between the shutter 210 and the cleaning member 250.

In this embodiment, a constitution in which the first moving member 12 and the second moving member 21 are driven by the same driving source and are moved simultaneously is employed, so that a mechanism in which the leading end of the shutter 210 and the part of the grid cleaning member 250 move while overlapping with each other with respect to the direction of gravitation during the opening operation of the shutter 210 was used. However, the constitution is not limited to this, but a constitution in which the shutter 210 and the grid cleaning member 250 move in the spaced state also during the opening operation of the shutter 210 may also be employed. However, in this case, there is a need to upsize the corona charger 2 or provide a mechanism for inputting drive to the first moving member 12 and the second moving member 21 at different timings.

(Positional Relationship of Shutter and Grid Cleaning Member)

The foreign matter on the grid 2*a* is a toner, an external additive, an electric discharge product, a dust or the like, but when the foreign matter removed by the grid cleaning member 250 accumulates on the shutter 210, the foreign matter constitutes a factor inviting an occurrence of an image defect and a deterioration of the shutter 210 itself. For that reason, there is a need to determine a positional relationship, such that the foreign matter does not deposit on the shutter 210 by the grid cleaning, by checking how the foreign matter on the grid 2*a* drops by the grid cleaning. For that reason, a state of the cleaning of the grid 2*a* by the grid cleaning member 250 was observed by a high-speed camera. That state is schematically shown in (a) of FIG. 17, and a foreign matter dropping behavior plotted on a graph is shown in (b) of FIG. 17.

The observation was made using the high-speed camera ("Phantom V 12.1", manufactured by Vision Research Inc.) at the number of pixels: 1056×768 and a shooting speed: 2,000 frames/sec. As the corona charger, a corona charger used for 10,000 sheets of an A4-sized image of 50% in image ratio in an environment of 32° C. and 85% without performing the grid cleaning operation. The dropping behavior of the foreign matter on the grid during the grid cleaning was checked by using the above-described high-speed camera and the corona charger, so that a dropping speed of the foreign matter was measured and calculated.

Figure 17:
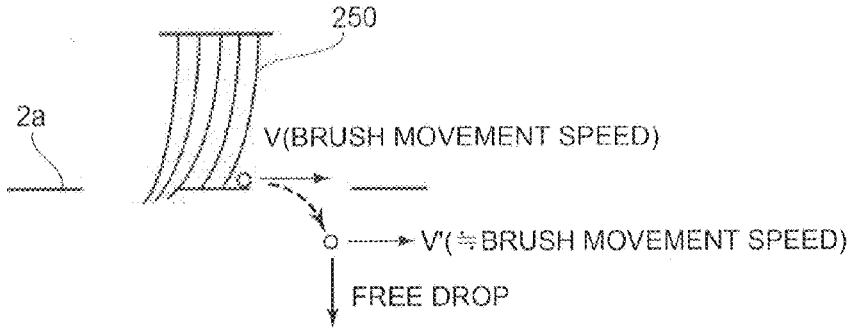
FIG. 17 includes a schematic view showing a behavior of a foreign matter on a grid electrode of the corona charger according to the embodiment and a graph.
Figure 17:
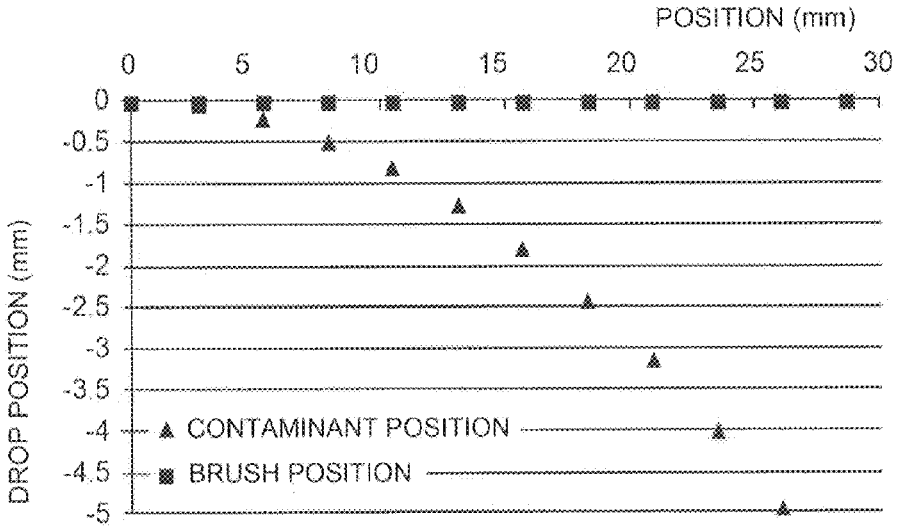
Figure 18:
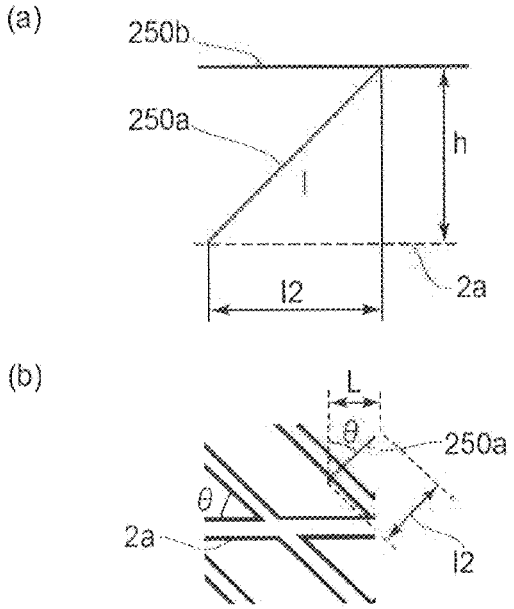
FIG. 18 includes schematic views showing flexure of a brush during grid cleaning of the corona charger according to the embodiment.
Figure 19:
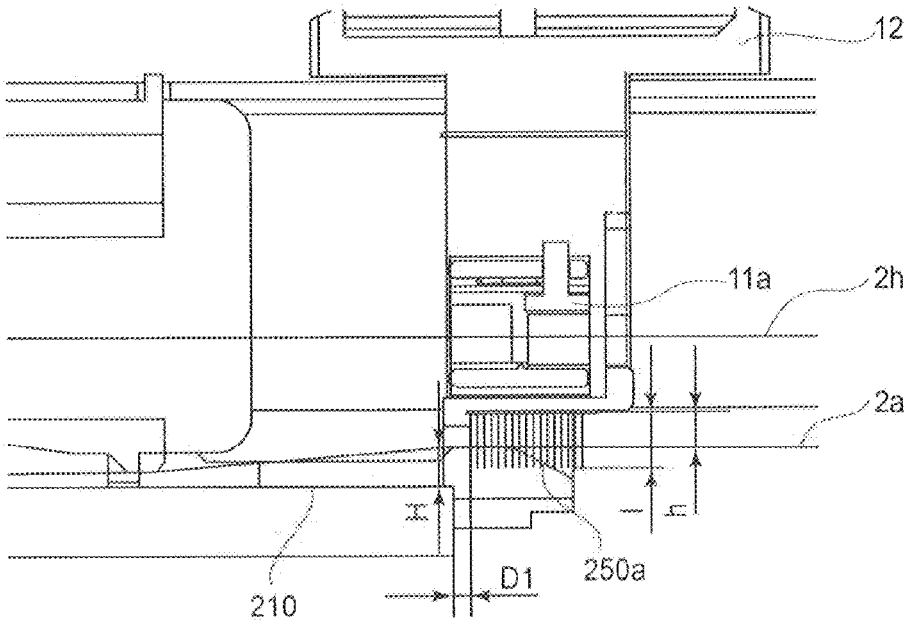
FIG. 19 is a schematic sectional view showing a position relationship of brush free ends of the corona charger according to the embodiment.

Here, when the shortest distance from a bonding bearing surface of a grid cleaning brush 250*a* of a brush heater 250*b* for supporting the grid cleaning brush 250*a* to the grid 2*a* is h (mm) and a brush fiber length of the grid cleaning brush 250*a* is l (mm), there is a need to satisfy a relationship of $H<l$ in order to effectively clean the grid 2*a* (FIG. 18). In this case, as shown in (a) of FIG. 17, the grid cleaning member 250 moves on the grid 2*a* at a speed V. During the movement, brush free ends of the grid cleaning brush 250*a* contacting the grid 2*a* clean the grid 2*a* while deforming depending on elasticity of the brush. At this time, the foreign matter on the grid 2*a* is removed from the grid 2*a* at a speed V' by the grid cleaning brush 250*a*.

From an observation result of the high-speed camera, the speed V' given to the foreign matter on the grid 2*a* was the substantially same speed as the movement speed V of the grid cleaning member. Therefore, to the foreign matter on the grid, an initial speed V (≈V') is given, so that the foreign matter freely drops from the grid. A result thereof shown in a graph is (b) of FIG. 17, and (b) of FIG. 17 is the graph of the removed foreign matter and the movement of the grid cleaning member 250. As shown in (b) of FIG. 17, a movement position is taken on the abscissa, and a drop position is taken on the ordinate, and when the removed foreign matter and the movement of the grid cleaning member 250 are graphed, with respect to the member direction, the foreign matter and the grid cleaning member 250 make the same movement. That is, unless the grid cleaning member 250 and the shutter 210 overlap with each other with respect to the movement direction, the foreign matter removed by the grid cleaning member 250 does not drop onto the shutter 210. As shown in FIG. 9, with respect to a distance D1 (mm) from the grid cleaning brush 250*a*, which is a part of the grid cleaning member 250, to the leading end of the shutter 210, in order to prevent the foreign matter from dropping onto the shutter 210, it is understood that there is a need to satisfy a relationship of D1≥0 mm.

However, in the case where the grid cleaning brush 250*a* has elasticity, the brush flexes, and therefore the brush free ends contacting the grid 2*a* move somewhat later than a base of the brush. For that reason, simply in the case of D1≥0 mm, the foreign matter drop onto the shutter 210 cannot be prevented. There is a need to set a distance, from a rearmost end where the grid cleaning brush 250*a* deforms during the operation to the leading end of the shutter 210, at 0 mm or more.

Figure 20:
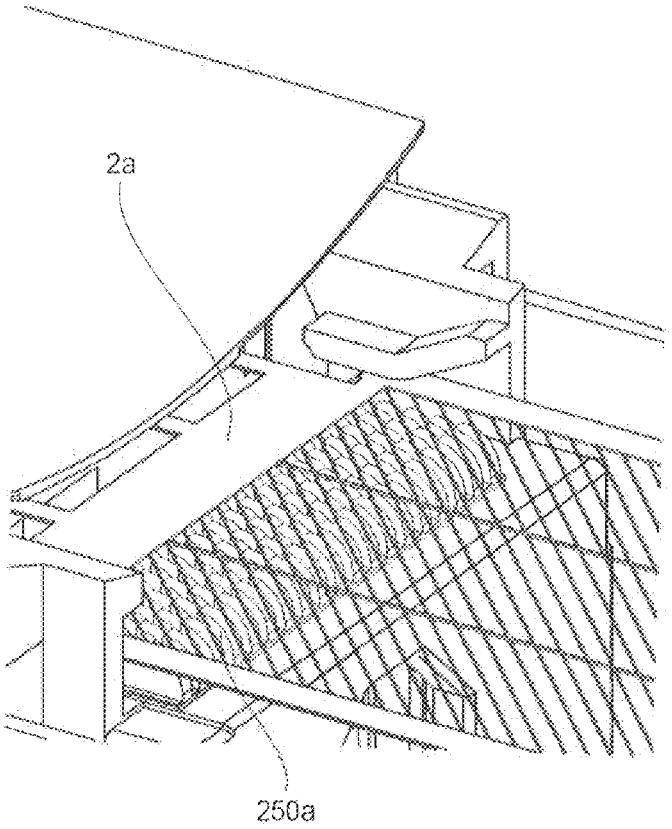
FIG. 20 is a perspective view showing a behavior of the brush during the grid cleaning of the corona charger according to the embodiment.
Figure 21:
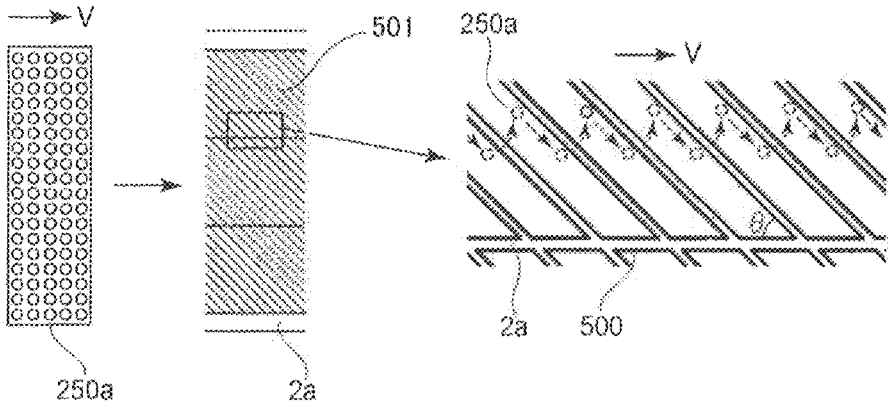
FIG. 21 is a schematic view showing the behavior of the brush during the grid cleaning of the corona charger according to the embodiment.

Next, motion of the free ends of the grid cleaning brush 250*a* will be described. A deformed state of the grid cleaning brush 250*a* is schematically shown in FIG. 20. FIG. 20 is schematically illustrated, and therefore is the figure such that an entire brush of the grid cleaning brush 250*a* follows a longitudinal direction of the grid 2*a*, but in actuality, the cleaning of the grid 2*a* is performed while the free ends in a state in which the free ends of the grid cleaning brush 250*a* penetrate through a mesh of the grid 2*a* and protrude from the mesh, in a state in which the free ends of the grid cleaning brush 250*a* not penetrate through the mesh and follow the surface of the grid 2*a*, and in a state in which the free ends of the grid cleaning brush 250*a* obliquely deform correspondingly to a hole shape of the mesh are coexist. FIG. 21 is a schematic view of movement of the grid cleaning brush 250*a* on the grid 2*a* as seen from the photosensitive drum 1 side. Further, FIG. 18 includes the figures schematically showing a single fiber of the brush in order to facilitate understanding of the movement of the free ends of the grid cleaning brush 250*a*, in which (a) of FIG. 18 is a side view of the single fiber as seen from a direction perpendicular to a brush flexing direction, and (b) of FIG. 18 is a bottom view as seen from the photosensitive drum side. As shown in FIG. 21, the grid cleaning brush 250*a* moves on the grid 2*a* at the moving speed V. In FIG. 21, the first moving member 21 itself moves at the moving speed V by transmission thereto the drive from the screw 12*b*.

However, in accordance with the mesh shape of the grid 2*a*, the grid cleaning brush 250*a* receives a component force along a base line 500 and oblique lines 501 of the grid 2*a*. For that reason, the free ends of the grid cleaning brush 250*a* delay compared with the base of the grid cleaning brush 250*a* with respect to the advancing direction. At this time, the grid cleaning brush 250*a* is caught by the mesh shape of the grid 2*a*, so that the brush moves along the mesh shape of the grid 2*a*. That is, as shown in the right side figure of FIG. 21, the brush cleans the grid 2*a* while producing zigzag motion. The zigzag motion is constituted by an operation for cleaning the flat surface portion of the grid 2*a* so as to ride on and sweep the flat surface portion and an operation in which the brush slides sideway on the cross sectional edges of the grid 2*a* along the mesh shape of the grid 2*a*.

By providing the grid shape with a pattern such as oblique lines 501 deviated from a line perpendicular to the rotational axis, of the photosensitive drum, which is the advancing and movement direction of the cleaning brush (≈by having an angle other than 90° with respect to the advancing and movement direction of the cleaning brush), the motion such that the grid cleaning brush free ends slide sideway on the cross-sectional edge portions of the grid is produced. By this side-sliding operation, it is possible to remove also a slight foreign matter at the cross-sectional edge with reliability. Further, the cleaning brush reliably cleans not only the cross-sectional edge portions but also the grid surface opposing the discharging wire by moving while contacting the grid surface in the zigzag motion of the plurality of brushes.

The above described zigzag motion move decreases as the grid shape is such that the angle of the oblique lines 501 with respect to the drum rotational axis which is the advancing and movement direction of the cleaning brush approaches 90°, so that the free ends of the grid cleaning brush 250 linearly move on the grid 2*a* with respect to the advancing direction. In the same grid cleaning member 250, when a relationship between a cleaning performance and the grid pattern angle when the cleaning is made a predetermined number of occurrences is studied, it was found that the cleaning performance for (cleaning) the foreign matter deposited on the surface of the grid 2*a* is high when the grid pattern angle may preferably 80° or less, more preferably be in a range of 45°±25°.

As shown in FIG. 18, compared with the base of the brush, the brush free ends of the grid cleaning brush 250*a* exhibiting the behavior as shown in FIG. 1 cause the delay. As seen from the side surface of (a) of FIG. 18, the grid cleaning brush 250 delays at the free ends relative to the base of the brush by a distance 12 (mm). The delay distance is the distance $l2=\sqrt{(l^2-h^2)}$ seen from the side surface at this time. Incidentally, naturally, the brush has elasticity, and therefore has a curve, as shown in (a) of FIG. 17, not a rectilinear line as shown in the side view of (a) of FIG. 18. Accordingly, (a) of FIG. 18 is a schematic view in the case where assumption is made that the delay distance l2 of the brush free ends is maximum. In the following, description will be made on the assumption that in the grid cleaning brush 250*a*, the delay distance l2 of the free ends relative to the base of the brush becomes maximum. In (b) of FIG. 18, the brush free ends seen from the lower surface in the photosensitive drum 1 side when the brush free ends delay are shown. According to (b) of FIG. 18, the brush free ends are l2 in length, and the brush moves along the grid mesh angle θ. A delay amount of the brush free ends of an advancing direction component of the brush at that time is $L=l2\times\sin\theta(=\sqrt{(l^2-h^2)}\times\sin\theta)$.

From the above, in the case where the cleaning of the grid 2*a* by the grid cleaning member 250 and the opening and closing operation of the shutter 210 are synchronized with each other, in order to prevent the foreign matter dropped by the grid cleaning from depositing on the leading end of the shutter 210 to contaminate the shutter 210, it is understood that in an operation with respect to a direction in which the shutter 210 is closed, a positional relationship between the grid cleaning brush 250*a* and the leading end of the shutter 210 may only be required to satisfy: D1−L≥0 mm.

On the other hand, in an operation with respect to a direction in which the shutter 210, the grid cleaning brush free ends deform in an opposite direction, and therefore deform in a direction in which the free ends are spaced from the leading end of the shutter 210. When a calculating method similar to that described above is used, it is understood that as an overlapping amount D1 between the leading end of the shutter 210, and the grid cleaning brush 250*a*, L−D2≥0 may only be required. Here, L is a value calculated on the assumption that the deformation of the grid cleaning brush 250*a* becomes maximum, and therefore depending on a deformation shape of the brush, there is a possibility that the brush having a deformation amount smaller than L exists. In this case, the grid cleaning brush 250*a* and the leading end of the shutter 210 overlap with each other with respect to the direction of gravitation in some cases, and therefore a possibility that the foreign matter dropped by the grid cleaning is dropped onto the shutter 210 is not 0. However, by the observation through the above-described high-speed camera, it is known that a position where the foreign matter starts to drop by the grid cleaning occupies 90% or more from the neighborhood of a central portion to a rear end side of the grid cleaning brush 250*a* with respect to the advancing direction, and therefore the influence by some overlapping in the free end side of the grid cleaning brush is small.

In view of the above, in this embodiment, a distance from the brush heater 250*b* for supporting the grid cleaning brush 250*a* to the grid 2*a* is h=2.0 mm, a brush fiber length of the grid cleaning brush 250*a* is l=3.0 mm, and a grid pattern angle is θ=45°, and therefore $l2=\sqrt{(3^2-2^2)}=\sqrt{5}$ mm, so that a delay amount of the brush free ends is $L=\sqrt{5}\times\sin 45°\approx 1.58$ mm. By this, when the shutter 210 is closed, it is understood that it may only be required that D1≥1.58 mm and D2≤1.58 are ensured and that the shutter 210 and the grid cleaning member 250 are moved by the opening and closing operation. From these values, in this embodiment, D1=15 (mm) and D2=1 (mm) were set.

By setting D1 and D2 as described above, in a closed state of the shutter 210, it becomes possible to shield the opening of the corona charger 2 with no gap with respect to the direction of gravitation and further to prevent the leading end of the shutter 210 from being concenratedly contaminated either in the opening and closing operations of the shutter 210.

In the above embodiments, by bringing the cleaning member 250 into contact with the second stepper, the movement of the cleaning member 250 is stepped to form the predetermined interval between the shutter 210 and the cleaning member 250, but when the closing operation of the shutter 210 is started, the predetermined interval may also be formed between the shutter 210 and the cleaning member 250 by moving the shutter 210 in advance of the cleaning member 250 by a retarding mechanism for retarding the start of movement of the cleaning member 250 while fixing the second moving member 12, by which the cleaning member 250 is held, for a predetermined period.

Further, in the above embodiments, the case where the driving member is the screw 12*b* is described, but the driving member is not limited to the screw but an endless belt may also be rotationally driven. In this case, a constitution in which the endless belt is provided with a plurality of projections and recesses, and the first moving member and the second moving member which is the heating portion are held so that a recessed portion is sandwiched between both-side projected portions, and in the case where the movement of the second moving member is stepped by the stepper, the second moving member rides over the projected portion and thus the endless belt idles is employed.

[Industrial Applicability]

According to the present invention, it is possible to suppress upsizing of the charging device while suppressing deposition of the foreign matter on the shutter in a constitution in which the cleaning member for cleaning the grid electrode and the shutter for shielding between the opening, provided in the casing of the charging device, and the photosensitive member are moved.

The invention claimed is:

1. A charging device comprising:

a casing provided with an opening opposing a member-to-be-charged;

a discharging wire provided in said casing;

a grid electrode provided in the opening;

a shutter for opening and closing the opening;

a cleaning member for cleaning said grid electrode; and a moving mechanism for reciprocating said shutter and said cleaning member along a longitudinal direction of the opening, wherein said moving mechanism includes a driving member for being rotationally driven, a first moving member, held by said driving member, for moving said shutter with rotational drive of said driving member, and a second moving member, held by said driving member, for moving said cleaning member with the rotational drive of said driving member, wherein said charging device further comprises:

a mechanism for forming an interval between said shutter and said cleaning member so that said cleaning member moves in advance of said shutter by a predetermined distance when said shutter moves in a closing direction; and a stopper for stopping movement of said cleaning member, and wherein said second moving member includes a holding portion for permitting idling when said shutter moves in the closing direction toward said cleaning member, stopped by said stopper, with rotation of said driving member.

2. A charging device according to claim 1, wherein said second moving member includes a contact portion contacting said stopper.

3. A charging device according to claim 1, wherein said stopper is provided at a longitudinal end portion of said casing.

4. A charging device according to claim 1, wherein said mechanism for forming the interval between said shutter and said cleaning member forms the interval of a predetermined distance between said shutter and said cleaning member by stopping movement of said cleaning member when said shutter is opened and by moving said shutter in an opening direction.

5. A charging device according to claim 4, wherein said stopper is a first stopper, and said mechanism for forming the interval between said shutter and said cleaning member includes a second stopper for stopping the movement of said cleaning member in the shutter opening direction when said shutter is opened.

6. A charging device according to claim 5, wherein said first stepper is provided at one longitudinal end portion of said casing, and said second stopper is provided at the other longitudinal end portion of said casing.

7. A charging device according to claim 1, wherein when said shutter ends movement in the closing direction, an end portion of said shutter with respect to the closing direction and at least a part of said cleaning member are disposed so as to overlap with each other as seen from the member-to-be-charged.

8. A charging device according to claim 1, wherein said driving member is a screw on which a spiral groove is formed, and said holding portion includes an engaging portion for engaging with the groove of said screw and a pressing portion for pressing said engaging portion.

9. An image forming apparatus comprising:

a photosensitive member;

a charging device, for electrically charging said photosensitive member, including a discharging wire, a casing provided with an opening which surrounds said discharging wire and which opposes said photosensitive member, a grid electrode provided in the opening, a shutter for opening and closing the opening, a cleaning member for cleaning said grid electrode, and a moving mechanism for reciprocating said shutter and said cleaning member along a longitudinal direction of the opening;

a toner image forming device for forming a toner image on said photosensitive member charged by said charging device; and an adjusting mechanism for adjusting an interval between said shutter and said cleaning member, wherein said adjusting mechanism moves said cleaning member in advance of said shutter when said shutter moves in the closing direction, and shorten an interval between a leading end of said shutter with respect to the closing direction and said cleaning member when said shutter closes.

* * * * *